US012520989B2

(12) United States Patent
Foster et al.

(10) Patent No.: US 12,520,989 B2
(45) Date of Patent: Jan. 13, 2026

(54) SYSTEM FOR DISPENSING A DETERGENT SOLUTION FROM A SOLID DETERGENT INTO A DISHWASHER COMPRISING A DISPENSER

(71) Applicant: Ecolab USA Inc., Saint Paul, MN (US)

(72) Inventors: Tobias Foster, Cologne (DE); Sven Klose, Essen (DE); Gerold Carlhoff, Tönisvorst (DE); Aleksandr Gelenberg, Dortmund (DE); Katharina Irmingard Miriam Horn, Marktschellenberg (DE); Martin Schweble, Siegsdorf (DE); Andreas Ruppert, Siegsdorf (DE)

(73) Assignee: Ecolab USA Inc., Saint Paul, MN (US)

( * ) Notice: Subject to any disclaimer, the term of this patent is extended or adjusted under 35 U.S.C. 154(b) by 103 days.

(21) Appl. No.: 18/628,395

(22) Filed: Apr. 5, 2024

(65) Prior Publication Data

US 2024/0335088 A1 Oct. 10, 2024

Related U.S. Application Data

(60) Provisional application No. 63/494,562, filed on Apr. 6, 2023.

(51) Int. Cl.

| | |
|---|---|
| ***A47L 15/00*** | (2006.01) |
| ***A47L 15/14*** | (2006.01) |
| ***A47L 15/44*** | (2006.01) |

(52) U.S. Cl.

CPC ..... *A47L 15/4436* (2013.01); *A47L 15/0055* (2013.01); *A47L 15/14* (2013.01); (Continued)

(58) Field of Classification Search

None

See application file for complete search history.

(56) References Cited

U.S. PATENT DOCUMENTS

| | | | |
|---|---|---|---|
| 1,904,157 | A | 4/1933 | Martin |
| 2,554,393 | A | 5/1951 | Webb |

(Continued)

FOREIGN PATENT DOCUMENTS

| | | |
|---|---|---|
| AU | 2020412715 | 2/2024 |
| CN | 101132727 | 2/2008 |

(Continued)

OTHER PUBLICATIONS

"European Application Serial No. 20841832.7, Communication Pursuant to Article 94(3) EPC mailed Feb. 6, 2025", 4 pgs.

(Continued)

*Primary Examiner* — Levon J Shahinian

(74) *Attorney, Agent, or Firm* — Schwegman Lundberg & Woessner, P.A.

(57) ABSTRACT

The present application relates to a system for dispensing a detergent solution from a solid detergent into a dishwasher said dishwasher comprising a washing chamber and being capable of performing cleaning cycles each including washing and rinsing periods; the system including a dispenser for dissolving solid detergent blocks and dispensing detergent solution, wherein the dispenser is configured to accommodate solid detergent, to be removably retrofittable into the dishwasher, and, to allow continuous release of all detergent solution as it is formed. In various applications the system may include a battery-powered control unit and a conductivity sensor, configured to measure the conductivity of the washing liquid and to provide the measured conductivity value to the control unit, said control unit is configured to process the conductivity value and to produce a signal.

20 Claims, 5 Drawing Sheets

(52) U.S. Cl.
CPC ..... *A47L 15/4445* (2013.01); *A47L 15/4463* (2013.01); *A47L 15/0005* (2013.01); *A47L 15/0007* (2013.01); *A47L 2401/023* (2013.01)

(56) References Cited

U.S. PATENT DOCUMENTS

| | | | |
|---|---|---|---|
| 5,137,694 | A | 8/1992 | Copeland et al. |
| 5,176,297 | A | 1/1993 | Mooney et al. |
| 5,593,648 | A | 1/1997 | Christie et al. |
| 5,967,158 | A | 10/1999 | Smith et al. |
| 6,048,501 | A | 4/2000 | Lemaire et al. |
| 6,773,668 | B1 | 8/2004 | EverSon et al. |
| 7,578,303 | B2 | 8/2009 | Daume et al. |
| 7,845,361 | B1 | 12/2010 | Verespej et al. |
| 8,536,107 | B2 | 9/2013 | Hahn |
| 8,578,950 | B2 | 11/2013 | Rosenbauer et al. |
| 8,721,804 | B2 | 5/2014 | Beshears, Jr. et al. |
| 8,734,591 | B2 | 5/2014 | Beshears, Jr. et al. |
| 9,144,366 | B2 | 9/2015 | Oner |
| 9,610,001 | B2 | 4/2017 | Classen et al. |
| 10,098,519 | B2 | 10/2018 | Willey et al. |
| 11,723,510 | B2 | 8/2023 | Jairam et al. |
| 2004/0163675 | A1 | 8/2004 | Hanh et al. |
| 2005/0039781 | A1 | 2/2005 | Song et al. |
| 2011/0180118 | A1 | 7/2011 | Schrott |
| 2014/0137911 | A1 | 5/2014 | Baldwin et al. |
| 2015/0053238 | A1 | 2/2015 | Lee et al. |
| 2016/0143506 | A1 | 5/2016 | Van Tol et al. |
| 2017/0042404 | A1 | 2/2017 | Kan et al. |
| 2017/0158988 | A1 | 6/2017 | Lo et al. |
| 2020/0069145 | A1 | 3/2020 | Helms |
| 2021/0186298 | A1 | 6/2021 | Jairam et al. |
| 2022/0175212 | A1 | 6/2022 | Dirrnberger et al. |
| 2023/0329518 | A1 | 10/2023 | Jairam et al. |

FOREIGN PATENT DOCUMENTS

| | | |
|---|---|---|
| CN | 204683529 | 10/2015 |
| CN | 107847101 | 3/2018 |
| CN | 209032260 | 6/2019 |
| CN | 209789797 | 12/2019 |
| CN | 114727742 | 7/2022 |
| DE | 2324185 | 11/1974 |
| DE | 19836857 | 9/2001 |
| DE | 10049316 | 1/2002 |
| DE | 19935728 | 7/2003 |
| DE | 102010003766 | 10/2011 |
| EP | 0461870 | 12/1991 |
| EP | 0823236 | 2/1998 |
| EP | 0878164 | 11/1998 |
| EP | 0678275 | 9/1999 |
| EP | 1415586 | 5/2004 |
| EP | 2604743 | 6/2013 |
| EP | 3106075 | 12/2016 |
| GB | 2312419 | 10/1997 |
| GB | 2339678 | 2/2000 |
| GB | 2349330 | 11/2000 |
| JP | H0430323 | 2/1992 |
| JP | H04309323 | 10/1992 |
| JP | H06503980 | 5/1994 |
| JP | 2003505169 | 2/2003 |
| JP | 6503980 | 4/2019 |
| JP | 2023504290 | 2/2023 |
| JP | 7389256 | 11/2023 |
| JP | 2024012642 | 1/2024 |
| WO | 9211797 | 7/1992 |
| WO | 9606666 | 3/1996 |
| WO | 2016081284 | 5/2016 |
| WO | 2017036513 | 3/2017 |
| WO | 2018036630 | 3/2018 |
| WO | 2021133834 | 7/2021 |
| WO | 2021245612 | 12/2021 |
| WO | 2024211804 | 10/2024 |

OTHER PUBLICATIONS

"International Application Serial No. PCT US2020 066687, International Search Report mailed Mar. 15, 2021", 5 pgs.
"International Application Serial No. PCT US2020 066687, Written Opinion mailed Mar. 15, 2021", 8 pgs.
"International Application Serial No. PCT US2020 066687, International Preliminary Report on Patentability mailed Jul. 7, 2022", 10 pgs.
"U.S. Appl. No. 17/131,158, Restriction Requirement mailed Jul. 13, 2022", 5 pgs.
"U.S. Appl. No. 17/131,158, Response filed Aug. 22, 2022 to Restriction Requirement mailed Jul. 13, 2022", 6 pgs.
"U.S. Appl. No. 17/131,158, Non Final Office Action mailed Sep. 26, 2022", 10 pgs.
"U.S. Appl. No. 17/131,158, Response filed Dec. 27, 2022 to Non Final Office Action mailed Sep. 26, 2022", 9 pgs.
"European Application Serial No. 20841832.7, Response to Communication pursuant to Rules 161(1) and 162 EPC filed Feb. 2, 2023", 53 pgs.
"U.S. Appl. No. 17/131,158, Notice of Allowance mailed Mar. 22, 2023", 8 pgs.
"Australian Application Serial No. 2020412715, First Examination Report mailed Jun. 30, 2023", 4 pgs.
"Japanese Application Serial No. 2022-534403, Notification of Reasons for Refusal mailed Jul. 4, 2023", w English translation, 10 pgs.
"Canadian Application Serial No. 3163326, Examiners Rule 86(2) Report mailed Jul. 19, 2023", 3 pgs.
"Australian Application Serial No. 2020412715, Response filed Sep. 21, 2023 to Office Action mailed Jun. 30, 2023", 14 pgs.
"Australian Application Serial No. 2020412715, Response Filed Sep. 21, 2023 to First Examination Report mailed Jun. 30, 2023", 10 pgs.
"Japanese Application Serial No. 2022-534403, Response Filed Sep. 28, 2023 to Notification of Reasons for Refusal mailed Jul. 4, 2023", W English Claims, 17 pgs.
"Canadian Application Serial No. 3163326, Response Filed Nov. 15, 2023 to Examiners Rule 86(2) Report mailed Jul. 19, 2023", 14 pgs.
"International Application Serial No. PCT US2023 076185, International Search Report mailed Jan. 19, 2024", 5 pgs.
"International Application Serial No. PCT US2023 076185, Written Opinion mailed Jan. 19, 2024", 8 pgs.
"Japanese Application Serial No. 2023-195254, Notification of Reasons for Refusal mailed May 14, 2024", w English translation, 8 pgs.
"Chinese Application Serial No. 202080081606.6, Office Action mailed Aug. 1, 2024", w English translation, 23 pgs.
"International Application Serial No. PCT US2024 023402, International Search Report mailed Sep. 5, 2024", 5 pgs.
"International Application Serial No. PCT US2024 023402, Written Opinion mailed Sep. 5, 2024", 13 pgs.
"Canadian Application Serial No. 3,163,326 , Voluntary Amendment Filed Aug. 15, 2024", 9 pgs.
"Japanese Application Serial No. 2023-195254, Response Filed Aug. 22, 2024 to Notification of Reasons for Refusal mailed May 14, 2024", w English Claims, 13 pgs.
"Chinese Application Serial No. 202080081606.6, Office Action mailed Mar. 22, 2025", W English Translation, 22 pgs.
"U.S. Appl. No. 18/339,531, Non Final Office Action mailed Jun. 4, 2025", 8 pgs.
"European Application Serial No. 20841832.7, Response Filed May 28, 2025 to Communication Pursuant to Article 94(3) EPC mailed Feb. 6, 2025", 46 pgs.
"Australian Application Serial No. 2023285698, First Examination Report mailed Mar. 4, 2025", 4 pgs.
"Chinese Application Serial No. 202080081606.6, Decision of Rejection mailed Jun. 9, 2025", W English Translation, 22 pgs.

SYSTEM FOR DISPENSING A DETERGENT SOLUTION FROM A SOLID DETERGENT INTO A DISHWASHER COMPRISING A DISPENSER

PRIORITY

This application claims the benefit of priority to U.S. Provisional Application Ser. No. 63/494,562, filed Apr. 6, 2023, which is incorporated by reference herein in its entirety.

TECHNICAL FIELD

The present patent application relates generally to a system for dispensing a detergent solution from a solid detergent into a dishwasher. In various embodiments the present subject matter includes apparatus for a dishwasher including a washing chamber and is configured to perform cleaning cycles each including washing and rinsing periods, the system comprising a dispenser and apparatus for detecting low detergent content in the washing liquid; a dispenser for dispensing a detergent solution from a solid detergent into a dishwasher; a set comprising a dispenser and exchangeable liquid inlets. The present subject matter also provides a method for dispensing a detergent solution from a dispenser in a dishwasher capable of performing cleaning cycles each including washing and rinsing periods.

BACKGROUND

A dishwasher, also referred to as a warewasher or warewashing machine, is a machine for automatically cleaning articles, such as dishes, trays, laboratory equipment, dinnerware, and kitchenware. A batch of objects to be cleaned (for example, dishes) can be loaded into a tub of the dishwasher, typically including racks and utensil holders, to be cleaned in a cleaning cycle that include washing and rinsing periods. During the washing period, a cleaning mixture formed by water and dishwasher detergent is sprayed into the loaded tub to blast the dishes. Then a major part of the cleaning mixture is kept in a tank while a small part is drained (which in the rinsing period is filled up again) before the rinsing period starts. During the rinsing period, water is sprayed into the washing chamber to remove residue of the cleaning mixture. After completion of the rinsing period the dishes can optionally be dried using air and/or heat during a drying period. A dishwasher may have various user-selectable settings for each cleaning cycle. The settings may define, for example, time, temperature, and repetition of each of the washing, rinsing, and drying period. The setting may also allow the user to choose which periods to include (e.g., rinsing only, drying only, rinsing and drying, or washing and rinsing without drying).

A common domestic dishwasher is an undercounter unit intended to be installed under a kitchen counter. Other types of dishwashers include industrial or commercial dishwashers for use in restaurants, hotels, and other commercial establishments with food services, e.g. hood-type dishwashers. Dishwasher detergents used in these dishwashers can include chemicals capable of cleaning, sanitizing, and/or reducing surface tension of water (and hence water spots on dishes). Such dishwasher detergents are made into various solid and liquid forms. Solid dishwasher detergents include chemicals made in forms of solid blocks such as tablets in various shapes.

The technical field of present application specifically refers to systems configured to allow for each load of solid detergent to last for multiple cleaning cycles.

One drawback of the systems according to the prior art is that either dishwasher detergent needs to be added before every cleaning cycle, or existing solid detergent dispensers, which are able to provide detergent solution over a plurality of cleaning cycles, are bulky as they require electronics and water sprayer for dissolving solid detergent. Further, installing means allowing dispensing detergent solution over a plurality of cleaning cycles into existing dishwashers fail due to limited space within the washing chamber required for an additional dispenser and storage space for the solid detergent sufficient to last for several cleaning cycles. Further drawbacks relate to the provision of suitable dosing of the detergent solution, and the required effort for the user to visually check, if sufficient solid detergent is present. A further problem is that changing the type of detergent, from liquid to solid detergent or from one detergent per cleaning cycle to a detergent lasting for multiple cleaning cycles, requires either replacement of the dishwasher or time-consuming and cost-intensive upgrading of the existing dishwasher.

The present subject matter provides apparatus and methods to overcome these drawbacks.

SUMMARY

To address these and other drawbacks, the present subject matter includes a system for dispensing a detergent solution from a solid detergent into a dishwasher said dishwasher comprising a washing chamber and being capable of performing cleaning cycles each including washing and rinsing periods, the system comprising a dispenser for dissolving solid detergent blocks and dispensing detergent solution, and a battery-powered device comprising a control unit and a conductivity sensor.

The present subject matter relates to specific dispensers for dispensing a detergent solution from a solid detergent into a dishwasher.

In addition, the present subject matter relates to a set comprising a dispenser for dispensing a detergent solution from a solid detergent into a dishwasher and an one or more exchangeable elements forming the liquid inlet of the dispenser.

The present subject matter further relates to a method for dispensing a detergent solution from a dispenser in a dishwasher capable of performing cleaning cycles each including washing and rinsing periods.

The present subject matter also relates to the use of the above system or the dispenser or the set for removably retrofitting and/or operating a dishwasher with said system.

In addition the present subject matter provides a dishwasher comprising said the system and/or configured to carry out the inventive method.

This summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

The drawings illustrate generally, by way of example, various embodiments discussed in the present document. The drawings are for illustrative purposes only and may not be to scale.

DETAILED DESCRIPTION

Figure 1:
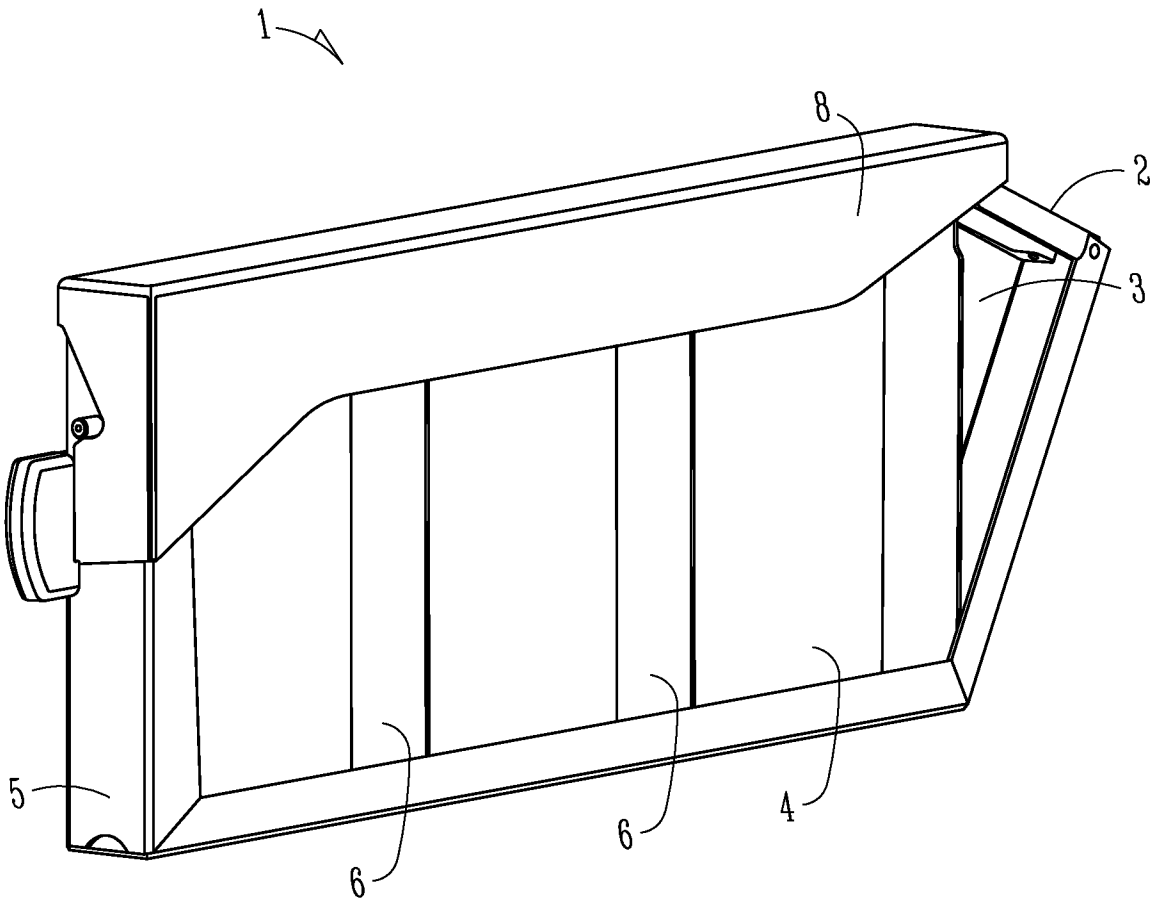
FIG. 1 is a perspective view of an embodiment of a dispenser 1 according to one embodiment of the system of the present subject matter to be arranged in a dishwasher.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The scope of the present invention is defined by the appended claims, along with the full scope of legal equivalents to which such claims are entitled.

In detail, the present subject matter provides the following:

System

The present subject matter provides a system for dispensing a detergent solution from a solid detergent into a dishwasher said dishwasher comprising a washing chamber and being capable of performing cleaning cycles each including washing and rinsing periods;

wherein the system comprises a dispenser for dissolving solid detergent blocks and dispensing detergent solution, wherein the dispenser is configured to accomodate solid detergent blocks in an amount sufficient to provide detergent solution for at least 10 cleaning cycles, to be removably retrofittable into the dishwasher, and, when removably mounted on an interior wall within the washing chamber of the dishwasher, to collect water or liquid sprayed within the washing chamber by a liquid inlet, to guide said collected water or liquid to the solid detergent blocks accomodated in the dispenser, whereby a portion of the solid detergent blocks is dissolved and a detergent solution is formed, and to allow continuous release of all detergent solution as it is formed;

a battery-powered device comprising a control unit and a conductivity sensor, wherein the battery-powered device is configured to operate independently of the dishwasher and to be removably retrofittable into the dishwasher, and, when the battery-powered device is mounted in the dishwasher, the conductivity sensor is configured to measure the conductivity of the washing liquid and to provide the measured conductivity value to the control unit, said control unit is configured to process the conductivity value and to produce a signal, if the conductivity value measured is below a preset threshold value, in order to indicate that the dispenser has to be refilled with solid detergent blocks; wherein the signal is displayed independently of the dishwasher.

The present application provides a system for dispensing a detergent solution produced from a solid detergent in a dishwasher, wherein the system can be arranged within the dishwasher and allows for each load of the solid detergent to last for multiple cleaning cycles. The system according to the present subject matter comprises a retrofittable dispenser passively dispensing a detergent solution as collected water or liquid is passing through the dispenser, and a retrofittable device being powered independently from the dishwasher for measuring the conductivity of the washing liquid and for producing a signal (which signal can also be referred to as an out-of-product-alarm), if conductivity is low. Being "passive" or "natural" means no additional force or energy is required to operate the dispenser or the dishwasher for collecting the water and directing its flow to the solid detergent accommodated in the dispenser, to form detergent solution by dissolving solid detergent and further to dispense the detergent solution via the liquid outlet. Compared to existing examples of solid detergent dispensers, the present subject matter provides a dispenser accommodating solid detergent blocks for providing detergent solution that is easier to produce (e.g., without need of electronics or water sprayer) and easier to use (e.g., substantially automatic detergent dispense, with solid detergent loaded between multiple cleaning cycles), while providing each cleaning cycle with substantially consistent amount and concentration of detergent solution.

As used herein the term "liquid" refers to washing liquid or water, if not otherwise indicated. The term liquid may also refer to rinsing liquid.

The system according to the present subject matter comprises a dispenser which is spatially and functionally retrofittable to existing dishwashers, including undercounter dishwashers and hood-type dishwashers, to allow storage of solid detergent blocks sufficient for several cleaning cycles and to allow their use to produce and dispense detergent solution. The system provided overcomes the problem of limited space for product storage and dispenser installation in the washing chamber of the dishwasher. The dispenser can hold one or more solid detergent blocks, receive water during washing and rinsing periods of a cleaning cycle to dissolve a portion of the solid detergent block(s) with a substantially even erosion, and continuously release the resulting detergent solution into the tub (which can also be referred to as a washing chamber or cleaning chamber) of the dishwasher.

The system according to the present subject matter eliminates the need for adding dishwasher detergent before every cleaning cycle, i.e. the present subject matter provides longevity of one product load. It also contributes to the consistency of concentration and amount of detergent dispensed by the system. Solid detergent block is a safer alternative to liquid detergent. The solid block form of a detergent is more concentrated than its liquid form, is not associated with risk of spilling, and may not need personal protective equipment. Solid detergent blocks also provide sustainability benefits from packaging and water content reduction as well as a smaller storage footprint at customer locations.

The system according to the present subject matter further comprises a battery-powered device comprising a control unit and a conductivity sensor which is spatially and functionally retrofittable to existing dishwashers. As battery-powered device it is powered independently from the dishwasher. The battery-powered device comprising a control unit and a conductivity sensor is configured to represent a retrofittable device, which is intended to be arranged into existing dishwashers for measuring the conductivity of the washing liquid and produces a signal (out-of-product-alarm) as required. This device monitors the conductivity of the washing liquid and, if the conductivity falls below a preset level the device produces a signal, such as an out-of-product-alarm, ensuring that no washing of dishes occurs with too low levels of detergent being dosed, resulting in strong product performance and accurately ensured dosage that both ensure cleaning and hygiene results and food safety. The levels of solid detergent required for such results are ensured by the out-of-product-alarm.

In addition, the system of the present subject matter ensures economically and environmentally sustainable operations and product use, as overdosing of product is avoided that would e.g. occur if users of alternative systems just throw multiple small-load, household type dishwasher tabs in the dishwasher tank, as it happens in typical state-of-the-art standard processes in the market.

As described above, the battery-powered device comprises a control unit and a conductivity sensor. According to the present subject matter the battery-powered device is configured to operate independently of the dishwasher. The conductivity sensor measures the conductivity of the washing liquid. The control unit processes the conductivity values measured by the conductivity sensor and, if the conductivity value measured is or falls below a preset threshold value the control unit produces a signal, in order to indicate to the user that the dispenser needs to be refilled with solid detergent blocks.

The signal is displayed independently of the dishwasher. This means that the battery-powered device does not communicate with the dishwasher or any control unit thereof, i.e. battery-powered device and dishwasher do not exchange any data, information or instructions. Further, the signal produced by the battery-powered device is not sent to the dishwasher to be displayed by the dishwasher, but the signal is either displayed by the battery-powered device, which is an independent module, e.g. in the form of a light signal having a specific colour (e.g. by LEDs), or the signal is send by the battery-powered device to an external device located outside of the dishwasher by wireless communication, and is displayed there. The external device may be a mobile device, such as a smartphone, or may be a computer. In case the signal is displayed by the battery-powered device itself, e.g. in the form of a light signal having a specific colour (e.g. by LEDs), the user will notice the signal upon opening the dishwasher for unloading cleaned goods and/or loading goods to be cleaned, and can refill the detergent chamber of the dispenser with solid detergent blocks.

As described above, the dispenser is for dissolving solid detergent blocks and dispensing detergent solution and is configured to be removably retrofittable into the dishwasher. The dispenser preferably comprises a mounting mechanism which allows the dispenser to be internally mounted in the dishwasher. The mounting mechanism allows the dispenser to be mounted in a location within the dishwasher without interfering with operation of the dishwasher, without substantially impacting load capacity of the dishwasher. In a preferred embodiment the mounting mechanism allows the dispenser to be attached to an interior surface of the washing chamber and more preferred allows the dispenser to be detachably attached to the interior surface of the washing chamber of the dishwasher. In a particularly preferred further embodiment, the mounting mechanism is configured to allow detachable attachment to the interior surface of the washing chamber of the dishwasher without any damage to the dishwasher or parts thereof, when the dispenser is detached. This may be preferably achieved by using an adhesive, e.g. an adhesive strip. The use of an adhesive is particularly advantageous as the dispenser can be mounted to the interior wall of the dishwasher and can be removed again without causing any damage to the dishwasher, e.g. by boring holes for screws. In a preferred embodiment the mounting mechanism includes a mounting plate configured to be mounted on an interior surface of the dishwasher, preferably by an adhesive or adhesive strip, and the dispenser is configured to be detachably attached to the mounting plate. In a further preferred embodiment the dispenser comprises a mounting mechanism configured to adjust the inclination of the dispenser. Adjusting the inclination of the dispenser allows to adjust the orientation of the dispenser in that way that the plane of the bottom side of the dispenser is inclined towards the liquid outlet. This allows to avoid retaining any detergent solution within the dispenser and to achieve emptying the detergent chamber.

A removable mounting mechanism allows dispenser to be detached from the dishwasher for cleaning dispenser as well as areas in the dishwasher behind dispenser, periodically or as needed, to avoid food soil and/or detergent buildup.

The dispenser is configured, when mounted on an interior wall within the washing chamber of the dishwasher, to collect water or liquid sprayed within the washing chamber, which means that a portion of the water or liquid which is sprayed within the washing chamber during the washing and rinsing periods is collected by the dispenser.

Further, the dispenser is configured, when mounted on an interior wall within the washing chamber of the dishwasher, to guide said collected water or liquid to the solid detergent blocks accommodated in the dispenser, whereby a portion of the solid detergent blocks is dissolved and a detergent solution is formed, and to allow continuous release of all of detergent solution as it is formed. This means that the dispenser releases detergent solution as soon as it is formed without withholding or retaining any detergent solution within the dispenser. That is, the dispenser allows free passage for the collected water and detergent solution from the detergent chamber to the liquid outlet without hindrances and without forming a liquid level within the dispenser. The dispenser allows to continuously release all of the formed detergent solution immediately after forming in order to achieve emptying the detergent chamber with respect to the content of detergent solution. In a preferred embodiment, the dispenser is mounted in the dishwasher in that way that the plane of the bottom side of the dispenser is inclined towards the liquid outlet, to avoid retaining any detergent solution within the dispenser and to achieve emptying the detergent chamber with respect to the content of detergent solution. The advantage of this configuration is that swelling of the solid detergent blocks is prevented, which may cause blockage of or damage to the dispenser. A further advantage is that the solid detergent blocks are not dissolved during time periods where the dishwasher is not in action.

As outlined above the dispenser is configured to store solid detergent blocks in an amount sufficient to provide detergent solution for at least 100 cleaning cycles on a 90-second dishwasher cleaning program, without refilling solid detergent blocks. In a particularly preferred embodiment said solid detergent blocks each comprises a washing agent and a rinsing agent.

In a further preferred embodiment the liquid inlet of the dispenser provides a clear opening space, wherein the dispenser is configured in that way that all of the collected water or liquid entering the dispenser enters the dispenser via said liquid inlet, wherein the liquid inlet preferably is designed as an exchangeable element. The clear opening space of the liquid inlet (forming the only liquid inlet of the dispenser when ready for operating), which is preferably designed as an exchangeable element, further preferred as an exchangeable perforated plate, defines the amount of water or liquid entering the dispenser, which is the "collected water or liquid", and thereby defines the amount of solid detergent being dissolved within a given time period. A particular advantage is that the liquid inlet is exchangeable by other liquid inlets having a different clear opening space, which is useful for adaptation to the user's needs, e.g. hardness of water in the location, where the dishwasher is operated. That is, the higher the degree of the hardness of the water is, the more detergent solution has to be produced within a given time limit, which means that more water or liquid needs to be collected by the dispenser, which is achieved by a larger clear opening space, compared to a lower degree of water hardness. In a further preferred embodiment the liquid inlet is substantially flat, arranged on a top side of the dispenser and is inclined so that soils are less likely to deposit and/or are more easily removed. In a particularly preferred embodiment the liquid inlet is designed as a substantially flat exchangeable perforated plate, which is arranged on a top side of the dispenser and is inclined.

In a particularly preferred embodiment the dispenser is configured to accommodate solid detergent blocks having a total weight of 400 g to 600 g and to provide a clear opening space of the liquid inlet, which preferably is designed as an exchangeable element (e.g. exchangeable perforated plate), from 0.2 $cm^2$ to 3.0 $cm^2$, preferably from 0.5 $cm^2$ to 2.0 $cm^2$. Such dispenser is configured to be operated in a dishwasher which is configured to spray about 300 to 400 L/min water or liquid during the washing cycle within the washing chamber, in order to allow the dispenser to produce sufficient detergent solution.

In another preferred embodiment the dispenser comprises a liquid inlet, a pre-chamber, a detergent chamber and a liquid outlet in fluid communication with each other in this order, wherein the dispenser is configured to pass all of the collected water or liquid from the liquid inlet to the pre-chamber, from the pre-chamber to the detergent chamber to form the detergent solution by dissolving a portion of the solid detergent blocks, and to pass the detergent solution from the detergent chamber to the liquid outlet. As outlined above, the dispenser is configured to allow continuous release of all of the formed detergent solution, as it is formed, which means that the dispenser releases detergent solution as soon as it is formed without withholding or retaining any detergent solution within the dispenser. Therefore, the dispenser allows free passage for the collected water and detergent solution from the detergent chamber to the liquid outlet without hindrances and without forming a liquid level within the dispenser. The dispenser allows to continuously release all of the formed detergent solution to achieve emptying the detergent chamber with respect to the content of detergent solution. In a preferred embodiment the liquid inlet of the dispenser is designed as an exchangeable element and is arranged on a top side of the pre-chamber and further preferably is designed as an exchangeable perforated plate.

In a further preferred embodiment the detergent chamber comprises a detergent opening on the top side for introducing the solid detergent blocks and a lid for closing the detergent opening, which lid when closed is sealing said detergent opening. The advantage is that inflow of liquid being sprayed within washing chamber via the detergent opening for solid detergent blocks is avoided, since the sole opening for the entry of collected water or liquid is via the liquid inlet, which is limiting and defining the amount of water or liquid which is entering the dispenser over a given time-period.

In a further preferred embodiment, the pre-chamber is arranged adjacent the detergent chamber and is separated from the detergent chamber by a partition wall leaving a fluid communication between the pre-chamber and the detergent chamber at the bottom. This configuration allows a defined guidance of the collected water or liquid within the dispenser.

In another preferred embodiment the detergent chamber is divided into more than one compartment by partition wall(s) leaving a fluid communication between adjacent compartments at the bottom. Preferably, three compartments are arranged. Each compartment is configured to accommodate one solid detergent block. The advantage is that solid blocks of detergent are prevented from wedging or blocking each other.

In another preferred embodiment the dispenser is further comprising an additional partition wall between the liquid outlet and the adjacent detergent chamber, (i.e. the adjacent upstream compartment of the detergent chamber) leaving a fluid communication between the detergent chamber and the liquid outlet at the bottom. The advantage is that the additional partition wall upstream of the liquid outlet has the function of a vapour barrier. In the absence of such additional partition wall or vapour barrier vapour may enter the liquid outlet may come into contact with the solid detergent blocks, which may lead to undesired wetting of the solid detergent. Due to the presence of such additional partition wall or vapour barrier vapour entering the liquid outlet may condense at this additional partition wall in order to avoid said vapour coming into contact with the solid detergent blocks.

The dispenser preferably has as general shape the form of a flat cartridge having a rear wall, a front wall, left wall, right wall, top wall or top side and bottom wall. The top side preferably comprises opening for introducing solid detergent blocks that can be closed by a lid, and the liquid inlet. The dispenser preferably comprises at the rear wall a mounting mechanism. In the simplest case the mounting mechanism is an adhesive or adhesive strip with which the rear wall of the dispenser is attached to the interior wall of the dishwasher. Further, preferred the liquid outlet is arranged at the lowermost point of one of the side walls, front wall or rear wall. More preferably, the liquid outlet is arranged at the lowermost point of one of the side walls.

In a particularly preferred embodiment of the system the dispenser comprises a front wall and wherein at least the portion of the front wall covering the detergent chamber is transparent, so that the user is able to visually inspect the solid detergent content in the dispenser.

Solid detergent block(s) are each a solid detergent in a form of a solid block. The solid detergent is a water-soluble chemical in a form of a solid block that can be used for cleaning and/or sanitizing objects being washed in the dishwasher. Typically, the solid block has a shape of a rectangular tablet. When desired, the rectangular tablet can be made with rounded edges and/or corners. The solid detergent can include a washing agent (which can also be referred to as a cleaning agent or a detergent), the washing agent and a rinsing agent (which can also be referred to as a rinsing aid), or the washing agent, the rinsing agent, a sanitizing agent. In a preferred embodiment, the solid detergent includes the washing agent, the rinsing agent, and the sanitization agent (which can also be referred to as a "three-in-one" detergent). In a particularly preferred embodiment the solid detergent includes two agents, the washing agent and the rinsing agent, without sanitization agent (which can also be referred to as a "two-in-one" detergent). Preferably the rinsing liquid is freshwater and the rinsing effect is achieved by a rinse agent comprised in the "two-in-one" detergent, which due to the washing period is present on the goods to be cleaned when rinsing starts. As consequence, the dishwasher requires only one tank for the washing liquid, since as rinse liquid freshwater is used.

In this application, a "dishwasher", which can also be referred to as warewasher or warewashing machine, includes any type of wash machine that can use detergent for cleaning and/or sanitizing purposes. Examples include an undercounter dishwasher or hood-type dishwasher for washing dinnerware, flatware, pots and pans, cutlery, flatware, glasses, kitchenware, serving pans, trays, and so on. Commercial dishwashing equipment examples can also use the present subject matter. A dishwasher includes a washing chamber formed by interior walls and a door of the dishwasher. In an example of the undercounter kitchen dishwasher, the door rotates up to about 90 degrees about a horizontal axis to switch between a fully closed state and to a fully open state. The door has an interior side and an exterior side that are both substantially vertical when the door is fully closed and substantially horizontal when the door is fully open.

In this application, a "cleaning cycle" includes one or more of a washing period and a rinsing period, and a drying period, depending on settings made by a user of the dishwasher. In a preferred embodiment, the dishwasher is configured of performing cleaning cycles consisting of washing and rinsing periods, i.e. the cleaning cycles do not comprise drying cycles. Therefore, in a preferred embodiment the dishwasher does not provide means for drying the cleaning goods. After cleaning the wash items essentially dry off outside the dishwasher, since drying can take place solely through the energy absorbed by the wash items from the hot rinse water.

The dishwasher being the target to be equipped with the system according to the present subject matter preferably is configured to provide selectable programs differing in the duration of the cleaning cycle. In particular the dishwasher is configured to provide programs, wherein the selectable duration of each cleaning cycle is from 60 seconds to 300 seconds per cleaning cycle, each cleaning cycle including a washing period and a rinsing period, and wherein the temperature is in the range of 50° C. to 85° C. It is further preferred that the dishwasher is configured in that during the washing period 300 to 400 l/min liquid is sprayed and in the rinsing period 2 to 3 l/rinse cycle water is sprayed.

Therefore, when referring to the dispenser according to the present subject matter or the system comprising such dispenser, wherein the dispenser is configured to accomodate solid detergent blocks in an amount sufficient to provide detergent solution for at least 100 cleaning cycles on a 90-second dishwasher cleaning program, when said dispenser is mounted within the dishwasher (preferably on an interior wall within the washing chamber of the dishwasher), said dishwasher is configured to provide programs, wherein the selectable duration of the cleaning cycles, each cleaning cycles including a washing period and a rinsing period, is from 60 seconds to 300 seconds per cleaning cycle.

In another preferred embodiment the dishwasher being the target to be equipped with the system according to the present subject matter preferably is configured to provide programs with cleaning cycles consisting of washing period and rinsing period.

In a further preferred embodiment the dishwasher being the target to be equipped with the system according to the present subject matter comprises a heating system for bringing the washing liquid and the rinse water to a preset temperature as well as a temperature sensor and a control unit to control said temperature. Further preferably, apart from the temperature sensor and the retrofitted conductivity sensor the dishwasher does not comprise any further sensors. That is the dishwasher does preferably not comprise turbidity sensors (usually used to determine the turbidity of the washing liquid), position sensors (usually used to determine the rotation of the spray arms), sensors to determine the pH of the washing liquid, or sensors to determine the hardness of tap water.

The typical handling of cleaning by a dishwasher is described as follows. The door is opened at least once between two consecutive cleaning cycles to allow loading of the dishes and/or other objects to be cleaned and unloading of the cleaned dishes and/or other objects. "Cleaning" can include cleaning only, sanitizing only, or cleaning and sanitizing, depending on, for example, whether the solid detergent blocks are capable of cleaning only, sanitizing only, or cleaning and sanitizing. A "washing period" includes a period or operational mode that is intended for a cleaning mixture formed by water and detergent to be applied to the dishes and/or other objects. A "rinsing period" includes a period or operational mode that is intended for water, or water and a chemical rinsing aid and/or a chemical sanitizer, to be applied to the dishes and/or other objects. Preferably, a "rinsing period" represents a period or operational mode that is intended for water to be applied to the dishes and/or other objects. As preferably the solid detergent includes two agents, the washing agent and the rinsing agent ("two-in-one" detergent), the rinsing liquid preferably is freshwater. Here the rinsing effect is achieved by a rinse agent comprised in the "two-in-one" detergent, wherein the rinse agent is contacted with the goods to be cleaned during the washing period. During the washing period the "two-in-one" detergent is used comprising washing agent and rinse agent and therefore the rinse agent is present on the goods to be cleaned when rinsing starts.

Some dishwashers (e.g., commercial dishwashers) may include a rinsing period that is primarily for sanitizing through heat and/or chemical applications and/or processes. A "drying period" includes a period or operational mode that is intended for the cleaned dishes and/or other objects to be dried by air flow and/or heat, without additional water and/or detergent applied. The dishwasher usually allows the user to choose whether to include the drying period in the cleaning cycle because the user can open the dishwasher door to allow the washed and rinsed dishes to dry naturally or remove the washed and rinsed dishes to another place for drying. Preferably, the dishwasher has not means for drying.

Dispenser

First Embodiment of the Dispenser

As mentioned above the present disclosure is also directed to a dispenser for dispensing a detergent solution from a solid detergent into a dishwasher, wherein the dispenser is configured

- to accomodate solid detergent blocks in an amount sufficient to provide detergent solution for at least 10 cleaning cycles,
- to be removably retrofittable into the dishwasher, and, when removably mounted on an interior wall within the washing chamber of the dishwasher,
- to collect water or liquid sprayed within the washing chamber by a liquid inlet,
- to guide said collected water or liquid to the solid detergent blocks accomodated in the dispenser, whereby a portion of the solid detergent blocks is dissolved and a detergent solution is formed, and
- to allow continuous release of all detergent solution as it is formed.

As used herein "allowing continuous release of all detergent solution as it is formed" means that the dispenser releases detergent solution as soon as it is formed without withholding or retaining any detergent solution within the dispenser. That is, the dispenser allows free passage for the collected water and detergent solution from the detergent chamber to the liquid outlet without hindrances and without forming a liquid level within the dispenser. The dispenser allows to continuously release all of the formed detergent solution immediately after forming in order to achieve emptying the detergent chamber with respect to the content of detergent solution.

The liquid inlet of the dispenser provides a clear opening space, wherein the dispenser preferably is configured in that way that all of the collected water or liquid entering the dispenser enters the dispenser via said liquid inlet. In a particularly preferred embodiment the liquid inlet is designed as an exchangeable element. This is advantageous, since the liquid inlet is exchangeable by other liquid inlets having a different clear opening space, which is useful for adaptation to the user's needs for example in view of the hardness of water in the location, where the dishwasher is operated.

In a preferred embodiment the dispenser comprises a liquid inlet, a pre-chamber, a detergent chamber and a liquid outlet in fluid communication with each other in this order, wherein the dispenser is configured to pass all of the collected water or liquid from the liquid inlet to the pre-chamber, from the pre-chamber to the detergent chamber to form the detergent solution by dissolving a portion of the solid detergent blocks, and to pass the detergent solution from the detergent chamber to the liquid outlet. Preferably, the liquid inlet of the dispenser is arranged on a top side of the pre-chamber and is designed as an exchangeable element.

In a further preferred embodiment the detergent chamber is further comprising a detergent opening on the top side for introducing the solid detergent blocks and a lid, which lid when closed is sealing said opening for introducing the solid detergent blocks.

Further preferred, the pre-chamber is arranged adjacent the detergent chamber and being separated from the detergent chamber by a partition wall leaving a fluid communication between the pre-chamber and the detergent chamber at the bottom. In another preferred embodiment the detergent chamber is divided into more than one compartment by partition wall(s) leaving a fluid communication between adjacent compartments at the bottom.

In another preferred embodiment the dispenser is further comprising an additional partition wall between the liquid outlet and the adjacent detergent chamber, (i.e. the adjacent upstream compartment of the detergent chamber) leaving a fluid communication between the detergent chamber and the liquid outlet at the bottom, said additional partition wall acting as a vapour barrier.

Preferably, the dispenser is configured to accommodate solid detergent blocks having a total weight of 400 g to 600 g and to provide a clear opening space of the liquid inlet from 0.2 $cm^2$ to 3.0 $cm^2$, preferably from 0.5 $cm^2$ to 2.0 $cm^2$. These configurations allow the dispenser to be operated in a dishwasher which is configured to spray about 300 to 400 L/min water or liquid during the washing cycle within the washing chamber, in order to allow the dispenser to produce sufficient detergent solution.

In another preferred embodiment the dispenser comprises a mounting mechanism allowing the dispenser to be internally mounted in the dishwasher, wherein the mounting mechanism comprises a mounting plate configured to be mounted on an interior surface of the dishwasher, preferably by an adhesive or adhesive strip, and the dispenser is configured to be detachably attached to the mounting plate.

Further preferred the dispenser comprises a mounting mechanism configured to adjust the inclination of the dispenser. This possibility for adjustment of the inclination of the dispenser within the dishwasher allows to adjust the orientation of the dispenser in that way that the plane of the bottom side of the dispenser is inclined towards the liquid outlet. By this, retaining any detergent solution within the dispenser and building up a liquid level of detergent solution being formed in the dispenser is prevented and thereby emptying the detergent chamber is achieved.

As described above, the dispenser preferably has as general shape the form of a flat cartridge having a rear wall, a front wall, left wall, right wall, top wall or top side and bottom wall. The top side preferably comprises opening for introducing solid detergent blocks that can be closed by a lid, and the liquid inlet. The dispenser preferably comprises at the rear wall a mounting mechanism. In the simplest case the mounting mechanism is an adhesive or adhesive strip with which the rear wall of the dispenser is attached to the interior wall of the dishwasher. Further, preferred the liquid outlet is arranged at the lowermost point of one of the side walls, front wall or rear wall. More preferably, the liquid outlet is arranged at the lowermost point of one of the side walls.

In a particularly preferred embodiment of the dispenser In a particularly preferred embodiment of the system the dispenser comprises a front wall and wherein at least the portion of the front wall covering the detergent chamber is transparent, so that the user is able to visually inspect the solid detergent content in the dispenser.

Second Embodiment of the Dispenser

The present disclosure further provides in an alternative embodiment (second embodiment) a dispenser for dispensing a detergent solution from a solid detergent into a dishwasher, said dispenser comprising a liquid inlet, a detergent chamber and a liquid outlet in fluid communication with each other in this order, wherein the dispenser is configured to pass all of the liquid collected by the dispenser from the liquid inlet to the detergent chamber to form the detergent solution by dissolving a portion of the solid detergent blocks, to pass the detergent solution from the detergent chamber to the liquid outlet, and to allow continuous release of all detergent solution as it is formed.

As described above, "allowing continuous release of all detergent solution as it is formed" means that the dispenser releases detergent solution as soon as it is formed without withholding or retaining any detergent solution within the dispenser. That is, the dispenser allows free passage for the collected water and detergent solution from the detergent chamber to the liquid outlet without hindrances and without forming a liquid level within the dispenser. The dispenser allows to continuously release all of the formed detergent solution immediately after forming in order to achieve emptying the detergent chamber with respect to the content of detergent solution.

In a preferred embodiment the liquid inlet is designed as an exchangeable element for varying a clear opening space of the liquid inlet.

In a preferred embodiment one or more further exchangeable element(s) are provided intended to be mounted to the dispenser to form the liquid inlet, said one or more further exchangeable element(s) each providing a specific clear opening space different from that of the first exchangeable element and different from each other.

The exchangeable element forming the liquid inlet defines the amount of solid detergent being dissolved within a given time period. The advantage of providing exchangeable liquid inlets, i.e. exchangeable elements, is that by exchanging the exchangeable element by another having a different clear opening space is that the dispenser can be adapted to the user's needs, e.g. hardness of water in the location, where the dishwasher is operated.

Further preferred, the dispenser comprises an additional chamber adjacent the detergent chamber and wherein the liquid inlet of the dispenser is arranged on a top side of the dispenser providing an opening into said additional chamber. Preferably, the additional chamber adjacent the detergent chamber is separated from the detergent chamber by a partition wall leaving a fluid communication between the additional chamber and the detergent chamber at the bottom.

Preferably, the liquid inlet of the dispenser provides a clear opening space, wherein the dispenser is configured in that way that all of the collected water or liquid entering the dispenser enters the dispenser via said liquid inlet.

In a particularly preferred embodiment the dispenser is configured to accommodate solid detergent blocks having a total weight of 400 g to 600 g and to provide a clear opening space of the liquid inlet from 0.2 $cm^2$ to 3.0 $cm^2$, preferably from 0.5 $cm^2$ to 2.0 $cm^2$. This is achieved by exchanging an exchangeable element forming the liquid inlet by another exchangeable element having a different clear opening space than the first one. Such dispenser is configured to be operated in a dishwasher which is configured to spray about 300 to 400 L/min water or liquid during the washing cycle within the washing chamber, in order to allow the dispenser to produce sufficient detergent solution.

In another preferred embodiment the detergent chamber is further comprising a detergent opening on the top side for introducing the solid detergent blocks and a lid, which lid when closed is sealing said opening for introducing the solid detergent blocks.

In another preferred embodiment the detergent chamber is divided into more than one compartment by partition wall(s) leaving a fluid communication between adjacent compartments at the bottom.

In a further preferred embodiment the dispenser further comprises an additional partition wall between the liquid outlet and the adjacent detergent chamber leaving a fluid communication between the detergent chamber and the liquid outlet at the bottom, said additional partition wall acting as a vapour barrier.

In another preferred embodiment the dispenser comprises a mounting mechanism allowing the dispenser to be internally mounted in the dishwasher, wherein the mounting mechanism comprises a mounting plate configured to be mounted on an interior surface of the dishwasher, and the dispenser is configured to be detachably attached to the mounting plate.

Preferably, the dispenser comprises a mounting mechanism comprising a device to adjust the inclination of the dispenser when arranged within the dishwasher.

As described above, the dispenser preferably has as general shape the form of a flat cartridge having a rear wall, a front wall, left wall, right wall, top wall or top side and bottom wall. The top side preferably comprises opening for introducing solid detergent blocks that can be closed by a lid, and the liquid inlet. The dispenser preferably comprises at the rear wall a mounting mechanism. In the simplest case the mounting mechanism is an adhesive or adhesive strip with which the rear wall of the dispenser is attached to the interior wall of the dishwasher. Further, preferred the liquid outlet is arranged at the lowermost point of one of the side walls, front wall or rear wall. More preferably, the liquid outlet is arranged at the lowermost point of one of the side walls.

In a further preferred embodiment of the dispenser the dispenser comprises a front wall and wherein at least the portion of the front wall covering the detergent chamber is transparent, so that the user is able to visually inspect the solid detergent content in the dispenser.

In a particularly preferred embodiment the dispenser is configured to accomodate solid detergent blocks in an amount sufficient to provide detergent solution for at least 10 cleaning cycles, to be removably retrofittable into the dishwasher, and, when removably mounted on an interior wall within the washing chamber of the dishwasher, to collect water or liquid sprayed within the washing chamber by a liquid inlet, to guide said collected water or liquid to the solid detergent blocks accomodated in the dispenser, whereby a portion of the solid detergent blocks is dissolved and a detergent solution is formed, and to allow continuous release of all detergent solution as it is formed.

Set Comprising Dispenser

In addition the present disclosure provides a set comprising

- a dispenser for dispensing a detergent solution from a solid detergent into a dishwasher, said dispenser comprising a liquid inlet, a detergent chamber and a liquid outlet, wherein the dispenser is configured to pass all of the liquid collected by the dispenser from the liquid inlet to the detergent chamber to form the detergent solution by dissolving a portion of the solid detergent blocks, to allow continuous release of the detergent via the liquid outlet, wherein the liquid inlet is designed as an exchangeable element; and
- a first exchangeable element intended to be mounted to the dispenser to form the liquid inlet, said first exchangeable element providing a specific clear opening space.

In a preferred embodiment, the set comprises one or more further exchangeable element(s) intended to be mounted to the dispenser to form the liquid inlet, said one or more further exchangeable element(s) each providing a specific clear opening space different from that of the first exchangeable element and different from each other.

In further preferred embodiment the dispenser is configured to accommodate solid detergent blocks having a total weight of 400 g to 600 g and is configured to be varied with respect to the clear opening space of the liquid inlet from 0.2 $cm^2$ to 3.0 $cm^2$, preferably from 0.5 $cm^2$ to 2.0 $cm^2$, by exchanging an exchangeable element by another. Such dispenser is configured to be operated in a dishwasher which is configured to spray about 300 to 400 L/min water or liquid during the washing cycle within the washing chamber, in order to allow the dispenser to produce sufficient detergent solution.

As described before, the dispenser is configured in that way that all of the collected water or liquid entering the dispenser enters the dispenser via said liquid inlet. According to this embodiment the liquid inlet is designed as an exchangeable element. The clear opening space of the liquid inlet (forming the only liquid inlet of the dispenser when ready for operating), which is preferably designed as an exchangeable element, further preferred as an exchangeable perforated plate, defines the amount of water or liquid entering the dispenser, which is the "collected water or liquid". Thereby the exchangeable element defines the amount of solid detergent being dissolved within a given time period. The advantage of providing exchangeable liquid inlets, i.e. exchangeable elements, is that by exchanging the exchangeable element by another having a different clear opening space is that the dispenser can be adapted to the user's needs, e.g. hardness of water in the location, where the dishwasher is operated. In a particularly preferred embodiment the liquid inlet is designed as a substantially flat exchangeable perforated plate, which is arranged on a top side of the dispenser and is inclined.

In a particularly preferred embodiment of the set the dispenser is configured to allow continuous release of all detergent solution as it is formed meaning that the dispenser releases detergent solution as soon as it is formed without withholding or retaining any detergent solution within the dispenser. That is, the dispenser allows free passage for the collected water and detergent solution from the detergent chamber to the liquid outlet without hindrances and without forming a liquid level within the dispenser. The dispenser allows to continuously release all of the formed detergent solution immediately after forming in order to achieve emptying the detergent chamber with respect to the content of detergent solution.

As described above, the dispenser preferably has as general shape the form of a flat cartridge having a rear wall, a front wall, left wall, right wall, top wall or top side and bottom wall. The top side preferably comprises opening for introducing solid detergent blocks that can be closed by a lid, and the liquid inlet. The dispenser preferably comprises at the rear wall a mounting mechanism. In the simplest case the mounting mechanism is an adhesive or adhesive strip with which the rear wall of the dispenser is attached to the interior wall of the dishwasher. Further, preferred the liquid outlet is arranged at the lowermost point of one of the side walls, front wall or rear wall. More preferably, the liquid outlet is arranged at the lowermost point of one of the side walls.

In another preferred embodiment of the set the dispenser comprises a front wall and wherein at least the portion of the front wall covering the detergent chamber is transparent, so that the user is able to visually inspect the solid detergent content in the dispenser.

Method

The present subject matter further provides a method for dispensing a detergent solution from a dispenser in a dishwasher capable of performing cleaning cycles each including washing and rinsing periods, the method comprising:

i. placing one or more solid detergent blocks each comprising a washing agent and a rinsing agent in a detergent chamber of the dispenser in an amount sufficient to provide detergent solution for at least 10 cleaning cycles;

ii. collecting a portion of water or liquid sprayed within the dishwasher during the washing and rinsing periods and using the collected water to form a detergent solution in the detergent chamber of the dispenser by dissolving a portion of the solid detergent;

iii. continuously releasing all of the detergent solution from the dispenser as it is formed;

iv. measuring the conductivity of the washing liquid by a conductivity sensor of a battery-powered device arranged within the dishwasher, v. providing the measured conductivity value to a control unit of the battery-powered device for processing, vi. producing a signal by the control unit, if the conductivity value is below a preset threshold value, in order to indicate that the dispenser has to be refilled with solid detergent blocks, and displaying the signal independently of the dishwasher.

According to the method of the present subject matter a detergent solution can be dispensed for a plurality of cleaning cycles from each load of the solid detergent accommodated in the dispenser. The detergent solution is prepared by the dispenser by passively collecting the water or liquid sprayed within the dishwasher and passing it through the dispenser, where it comes into contact with the solid detergent which is dissolved with a substantially even erosion. Being "passive" means no additional force or energy is required to operate the dispenser or the dishwasher for collecting the water and directing its flow to the solid detergent accommodated in the dispenser, to form detergent solution by dissolving solid detergent and further to dispense the detergent solution via the liquid outlet. The detergent solution produced thereby is continuously released into the washing chamber of the dishwasher, whereby a substantially consistent amount and concentration of detergent solution is provided for each cleaning cycle over a plurality of cleaning cycles. Therefore, according to the method of the present subject matter the need for adding dishwasher detergent before every cleaning cycle is eliminated.

Importantly, according to the method of the present subject matter all (or substantially all) of the detergent solution is released from the dispenser as soon as it is formed. This means that compared to existing examples of solid detergent dispensers no detergent solution is withheld or retained within the dispenser and a free passage for the detergent solution being formed is provided within the dispenser without hindrances and without forming a liquid level within the dispenser. This allows continuously release of the formed detergent solution immediately after forming in order to achieve emptying the detergent chamber with respect to the content of detergent solution. This continuous release of detergent solution is advantageous as is prevents swelling of the solid detergent blocks, which otherwise may cause blockage of or damage to the dispenser. The method of the present subject matter also ensures economically and environmentally sustainable operations and product use, as overdosing of product is avoided that would e.g. occur if users simple place multiple small-load, household type dishwasher tabs in the dishwasher tank.

According to the method of the present subject matter the conductivity of the washing liquid is measured by a conductivity sensor and the respective data are processed. If the conductivity value is below a preset threshold value a signal is produced which is displayed independently of the dishwasher. This signal is an indication to the user that the dispenser has to be refilled with solid detergent (out-of-product-alarm). Such out-of-product-alarm ensures that no washing occurs with too low levels of detergent being dosed, resulting in strong product performance and accurately ensured dosage that both ensure cleaning and hygiene results and food safety. These steps are performed by an independent device, which is powered independently from the dishwasher. The signal may be displayed by the battery-powered device, preferably in the form of a light signal. Alternatively, the signal may be sent by the battery-powered device to an external device located outside of the dishwasher by wireless communication, for displaying by the external device. The advantage of the use of independent and retrofittable devices, such as dispenser and battery-powered device comprising a control unit and a conductivity sensor is that there is no need to replace technically relative simple dishwashers, once the method of the present subject matter shall be carried out, but such existing dishwashers can be upgraded using such independent devices.

In a preferred embodiment the method comprises before steps i. to vi. the following steps a. to c. in any order:

a. selecting and installing a specific clear opening space of a liquid inlet of the dispenser;
b. removably retrofitting a dispenser in the dishwasher; and
c. removably retrofitting a battery-powered device comprising a control unit and a conductivity sensor in the dishwasher.

The clear opening space of the liquid inlet defines the amount of water or liquid entering the dispenser and thereby the amount of solid detergent being dissolved within a given time period. The option to select from different liquid inlets (as the liquid inlets are exchangeable) and different clear opening spaces, is advantageous as the inflow of spayed water or liquid into the dispenser can be adapted to the user's needs, e.g. in view of hardness of water in the location, where the dishwasher is operated. The higher the degree of the hardness of the water is, the more detergent solution has to be produced within a given time limit, which means that more water or liquid needs to be collected by the dispenser, which is achieved by a larger clear opening space, compared to a lower degree of water hardness. Therefore, in a preferred method the liquid inlet is designed as an exchangeable element and the method further comprises a step of altering the specific clear opening space of said liquid inlet by exchanging the exchangeable element by another exchangeable element having a different specific clear opening space.

The present disclosure is explained in more detail by the following examples.

FIG. 1 is a perspective view of an embodiment of a dispenser 1 according to the system of the present subject matter to be arranged in a dishwasher. The system according to the present subject matter comprises a dispenser 1 for dispensing a detergent solution and a battery-powered device for measuring the conductivity of the washing liquid. An example of this system is discussed below with reference to FIG. 5.

The dispenser 1 is designed generally in the form of a flat cartridge having a rear wall, a front wall, left wall, right wall, top wall (or top side) and bottom wall. The top side comprises an opening 9 for introducing solid detergent blocks that can be closed by a lid 8. The top side of the dispenser 1 also comprises a liquid inlet 2. At the rear wall the dispenser 1 comprises a mounting mechanism for attachment to the interior wall of the dishwasher. A liquid outlet 5 is arranged at the lowermost point of one of the side walls 10.

The dispenser 1 comprises a transparent window in the front wall allowing the user to visually inspect the interior of the dispenser 1 and thereby the amount of solid detergent present in the dispenser 1.

The dispenser 1 shown in the figure further includes a liquid inlet 2, a pre-chamber 3, a detergent chamber 4, a liquid outlet 5, partition walls 6 to subdivide the detergent chamber 4 into several compartments each holding a solid detergent block (not shown), and an additional partition wall 7 acting as a vapour barrier (not visible in FIG. 1). The pre-chamber 3 is separated by the adjacent compartment of the detergent chamber 4 by a partition wall. All partition walls provide a passage at the bottom so that the pre-chamber 3 and all compartments of the detergent chamber 4 are in liquid communication with each other and the liquid outlet 5 arranged in the bottom of the side wall of the dispenser 1 opposite to the pre-chamber 3.

Detergent chamber 4 which is divided here in 3 compartments can accommodate the solid detergent blocks. Liquid inlet 2 is in fluid communication with detergent chamber 4 via pre-chamber 3 and can collect water sprayed into the dishwasher during the washing and rinsing periods and allows the collected water to flow into the pre-chamber 3 and then into the detergent chamber 4 to form the detergent solution by dissolving a portion of the solid detergent. Liquid outlet 5 arranged in the left side wall of the dispenser 1 is in fluid communication with the detergent chamber 4 and continuously releases the detergent solution from detergent chamber 4 as soon as the detergent solution has been formed. The dispenser 1 is configured to perform its functions automatically and is not electrically powered.

The dispenser 1 is mounted at an interior wall of the washing chamber of the dishwasher, advantageously in that way that the plane of the bottom is inclined by for example 1 to 3° towards the liquid outlet 5. This allows continuous release of all of the formed detergent solution to achieve emptying the detergent chamber 4 and generally the dispenser 1 with respect to the content of detergent solution and avoids retaining any detergent solution within the dispenser 1 and to achieve emptying the detergent chamber 4 via liquid outlet 5.

The detergent chamber 4 can accommodate solid detergent block(s). The detergent chamber 4 includes a detergent opening on the top side to receive solid detergent block(s) (detergent opening not visible in FIG. 1). The dispenser 1 further comprises a lid 8 to close the detergent opening to retain the received block(s). Lid 8, when closed, is sealing said detergent opening, thereby preventing inflow of liquid being sprayed within washing chamber via the detergent opening. The sole opening for the entry of collected water or liquid into the dispenser 1 is via the liquid inlet 2.

The liquid inlet 2 is positioned and oriented to passively or naturally collect water sprayed into the dishwasher during the washing and rinsing periods (or any periods during which water is sprayed into the dishwasher) and to passively or naturally allow the collected water to flow into detergent chamber 4 to form the detergent solution by dissolving a portion of solid detergent block(s). Being "passive" or "natural" means no additional force or energy is required to operate the dispenser or the dishwasher for collecting the water and directing its flow into detergent chamber 4, to form detergent solution by dissolving solid detergent and further to dispense the detergent solution via the liquid outlet 5.

The liquid inlet 2 is required to partially expose the solid detergent placed in the detergent chamber 4 to the water sprayed into the dishwasher. The liquid inlet 2 is the only opening for entry of liquid so that all of the collected water or liquid entering the dispenser enters the dispenser via said liquid inlet 2.

Figure 2:
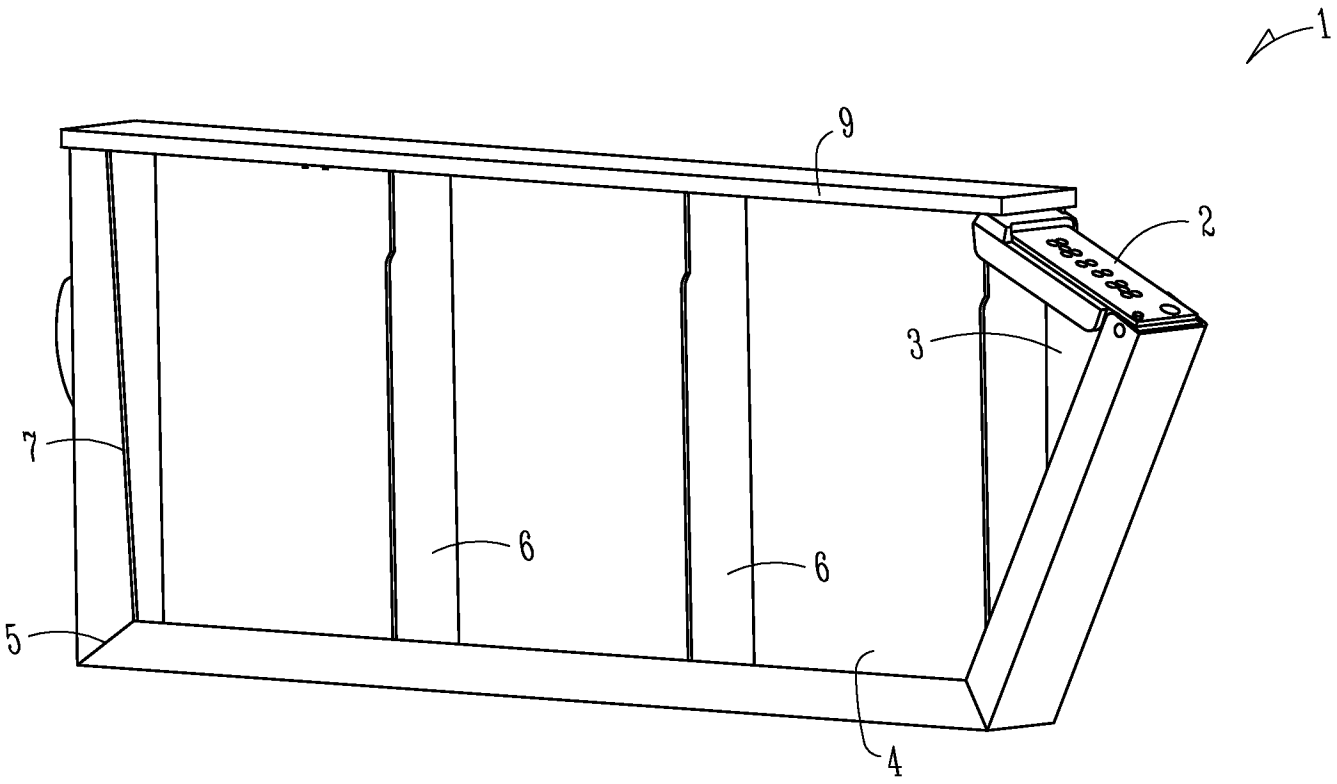
FIG. 2 is another perspective view of the dispenser 1 shown in FIG. 1.

FIG. 2 is another perspective view of the dispenser shown in FIG. 1 from the right side. The dispenser 1 includes a liquid inlet 2, a pre-chamber 3, a detergent chamber 4, a liquid outlet 5, partition walls 6 to subdivide the detergent chamber 4 into several compartments each holding a solid detergent block (not shown), and an additional partition wall 7 acting as a vapour barrier. The liquid outlet 5 is not visible in the perspective shown in FIG. 2 as the frame (for holding the transparent window) at the front wall of the dispenser 1 is covering the view to the liquid outlet 5.

As described, liquid inlet 2 can collect water sprayed into the dishwasher. The collected water enters pre-chamber 3 and is passed on to the detergent chamber 4. Preferably, the liquid inlet 2 is formed by an exchangeable perforated plate 2 as shown in the figure. The clear opening space of the exchangeable perforated plate 2 defines the amount of water or liquid entering the dispenser 1, so that all of the collected water or liquid entering the dispenser enters the dispenser via said liquid inlet 2. The exchangeable element or perforated plate forming the liquid inlet 2 provides a specific clear opening space. The exchangeable element or perforated plate forming the liquid inlet 2 may be exchanged by a different one having a different clear opening space in order to adapt the inflow of liquid into dispenser 1 for adaptation to the user's needs, e.g. hardness of water in the location, where the dishwasher is operated. In the embodiment shown in the figure the perforated plate 2 is inclined for preventing deposition of soils.

As described, detergent chamber 4 is configured to accommodate solid detergent block(s). The detergent chamber 4 comprises a detergent opening 9 on the top side of the dispenser 1 for introduction of the solid detergent block(s) into the detergent chamber 4. Further, a lid (not shown in FIG. 2) is arranged to close the detergent opening 9.

Figure 3:
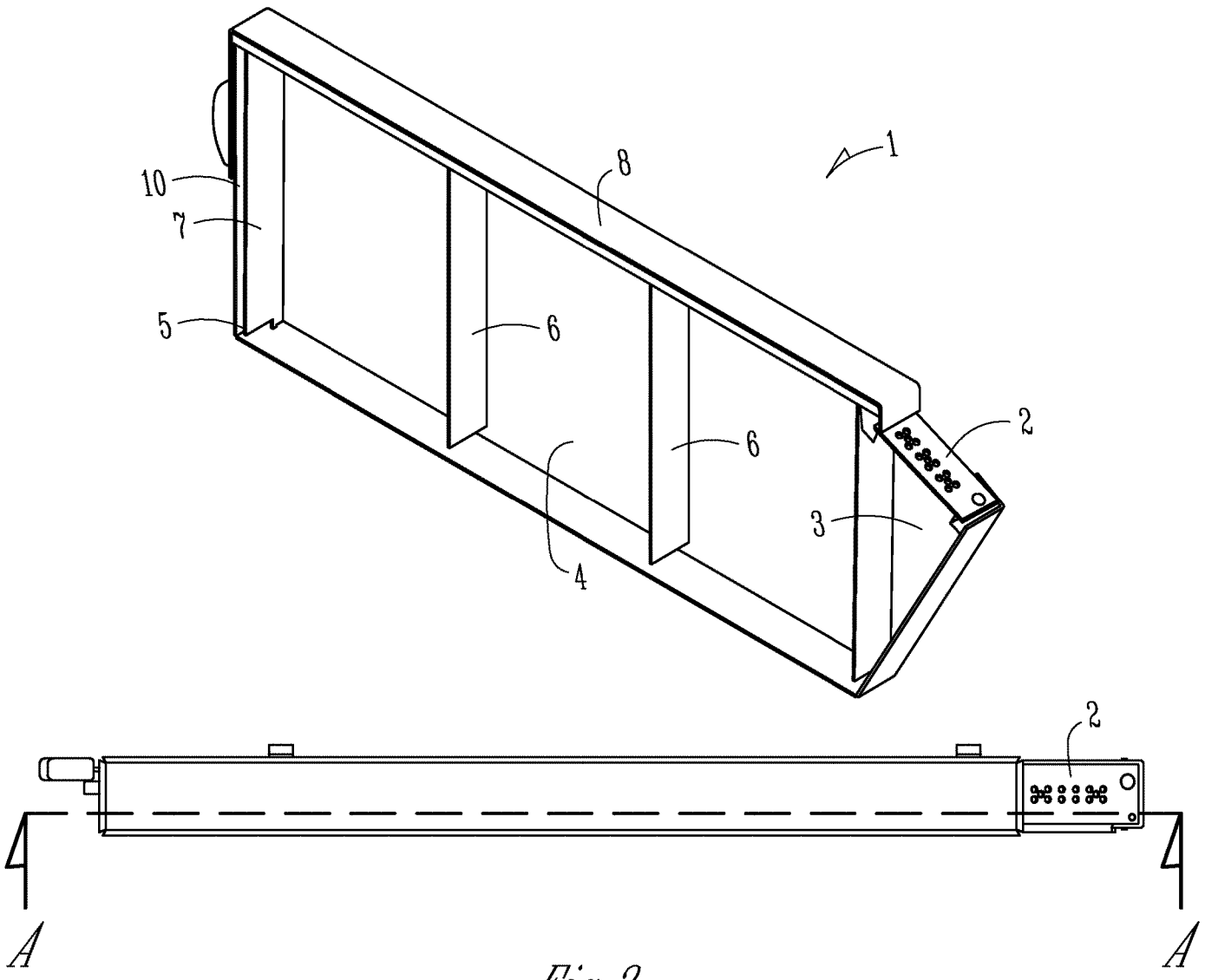
FIG. 3, lower drawing, is a top view of the dispenser 1 shown in FIGS. 1 and 2. The upper drawing is a sectional view of the dispenser 1 along line A-A shown in the lower drawing of FIG. 3.

FIG. 3 is a further view of the dispenser according to one embodiment of the present subject matter. The lower drawing is a top view of the dispenser 1 shown in FIGS. 1 and 2. The top side of the dispenser is mainly covered by the lid, which is closing the detergent chamber. In addition, the figure shows liquid inlet 2 designed as a perforated plate.

The upper drawing of the figure is a sectional view of the dispenser 1 along line A-A shown in the lower drawing. The dispenser 1 includes a liquid inlet 2 designed as a perforated plate, a pre-chamber 3, a detergent chamber 4 with three compartments, the detergent chamber 4 being divided by partition walls 6, an additional partition wall 7, a liquid outlet 5 arranged in the left side wall 10 and a lid 8 covering the detergent opening.

As described above, liquid inlet 2 designed as a perforated plate is in fluid communication with detergent chamber 4 via pre-chamber 3. Liquid inlet 2 collects water which flows into the pre-chamber 3 and then into the detergent chamber 4 containing the solid detergent blocks (not shown) to form the detergent solution by dissolving a portion of the solid detergent.

The upper drawing of the figure shows that the pre-chamber 3, the compartments of the detergent chamber 4, and the liquid outlet 5 are in fluid communication. The fluid communication is achieved in that the partition wall between pre-chamber 3 and detergent chamber 4, the partition walls 6 dividing the detergent chamber 4 into compartments and the additional partition wall 7 each leaves a flow through opening at the bottom of the dispenser 1. This feature allows a continuous release of the detergent solution formed in the detergent chamber 4 as soon as the detergent solution has been formed. As can be shown from the figure dispenser 1 releases detergent solution as soon as it is formed without withholding or retaining any detergent solution within the dispenser 1. That is, the dispenser allows free passage for the collected water and detergent solution from the detergent chamber 4 to the liquid outlet 5 arranged at the bottom of the side wall 10 without hindrances and without forming a liquid level within the dispenser 1.

The embodiment of the dispenser 1 shown in the figure further comprises an additional partition wall 7 between the liquid outlet 5 and the adjacent upstream compartment of the detergent chamber 4. The purpose of the additional partition wall 7 upstream of the liquid outlet 5 has the function of a vapour barrier. Vapour that may enter the liquid outlet 5 condenses at this additional partition wall 7 before it is able to reach the solid detergent blocks located within the detergent chamber 4 which may lead to undesired wetting of the solid detergent. The additional partition wall 7 is arranged in a small distance and in parallel to the side wall 10 comprising the liquid outlet 5, thereby creating an additional narrow chamber arranged therebetween.

Figure 4:
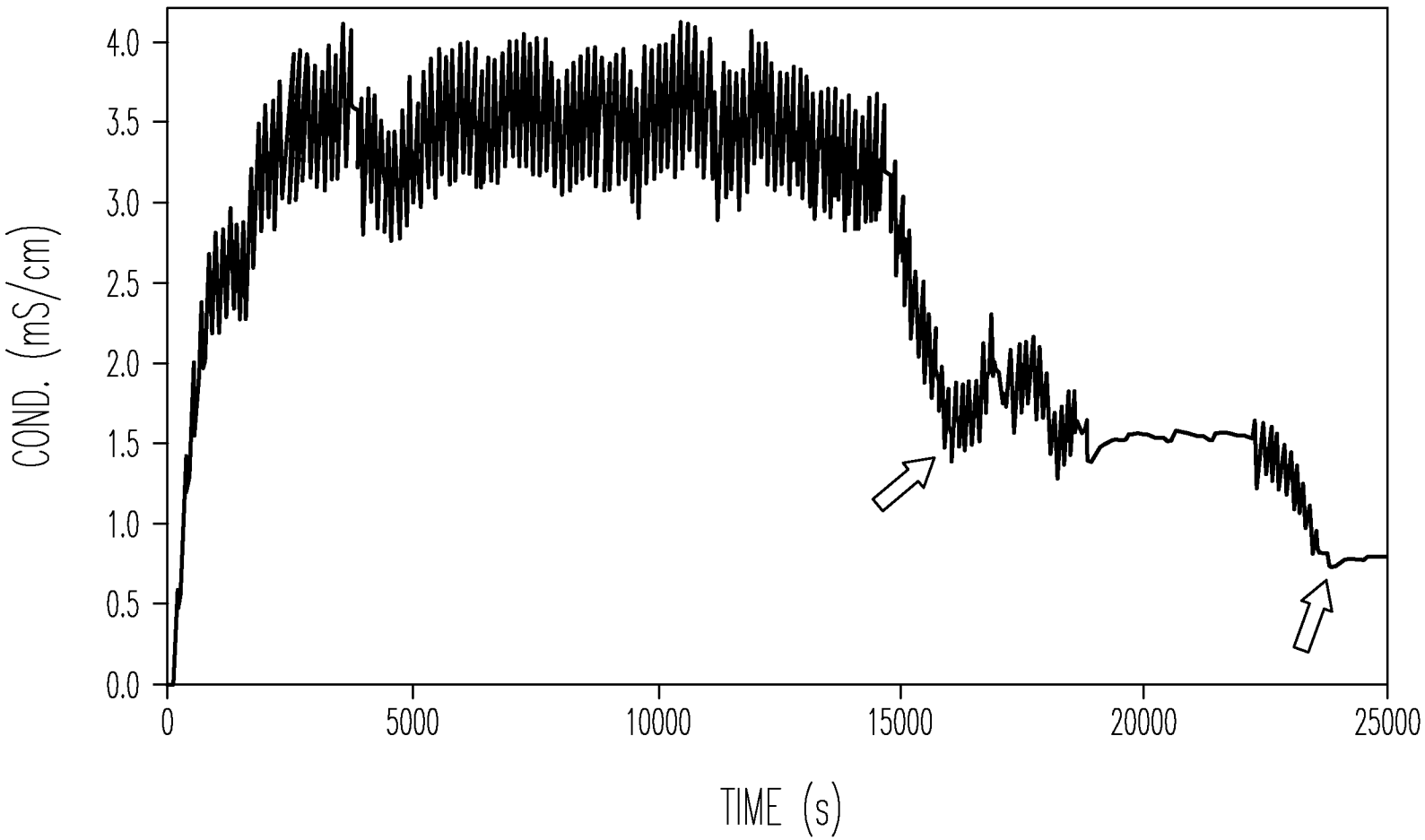
FIG. 4 is a graph showing conductivity measurements of the concentration of the solid detergent in the solution within the dishwasher tank, and in parallel a visual control of the amount of solid product left in the dispenser.

FIG. 4 is a graph showing conductivity measurements of the concentration of the solid detergent in the solution within the dishwasher tank, and in parallel a visual control of the amount of solid product left in the dispenser.

For checking the out-of-product-alarm three solid detergent blocks comprising two agents, the washing agent and the rinsing agent, having a total weight of 525 g, were filled into the dispenser placed within an undercounter dishwasher. The dispenser used in the experiment was of the type illustrated in FIGS. 1 to 3. The clear opening space of the liquid inlet 2 of the dispenser was 1.0 $cm^2$. Further, a specific sensor was placed within the dishwasher tank to measure the conductivity of the washing liquid. The dishwasher was started to run a plurality of cycles each comprising a washing period of 70 seconds and rinsing period of 10 seconds at a temperature of 60° C. in the cleaning cycle and 83° C. in the rinse cycle. In the washing period 350 l/min washing liquid were circulated and in the rinsing period 2-3 l/rinse cycle water was sprayed onto the dishes.

As the conductivity represents the concentration of the solid detergent in the solution, the washing liquid within the dishwasher tank was subjected to a conductivity measurement by a specific sensor. Additionally, in parallel a visual monitoring of the amount of solid detergent blocks left in the dispenser was carried out. It was observed that the change in conductivity over time correlated with blocks being more and more dissolved, i.e. conductivity correlated with visual detection of block disappearing. The arrows in FIG. 4 indicate the time point at which the total amount of solid detergent contained in the dispenser became rather low. Initially, the conductivity build up rapidly and was constant for about 15000 s at a conductivity of around 3.5 S/cm. Then the conductivity dropped to about 1.5 S/cm corresponding to a total of 200 g of solid detergent left in the dispenser (left arrow). After a further reduction the conductivity was about 0.7-0.8 S/cm corresponding to a total of 50 g of solid detergent left in the dispenser (right arrow), out of a total of a full load (525 g) of solid detergent initially loaded into the dispenser before starting the experiment. The experiment showed that the conductivity signal is an accurate measure of the solid product level in the dispenser.

By these tests, it could be shown that a solid detergent product was dissolved in a controlled way by the dispenser, whereby the conductivity measurement and accordingly, the out-of-product-alarm (mediated by the battery-powered device comprising a control unit and a conductivity sensor) based on the same measurement principle of measuring conductivity, indicated when the product level in the dishwasher is too low and solid detergent product needed to be reloaded.

The conductivity at which the alarm is triggered can be freely chosen, allowing to remotely alert the user of the system to reload product in advance to complete product consumption in the dispenser.

Figure 5:
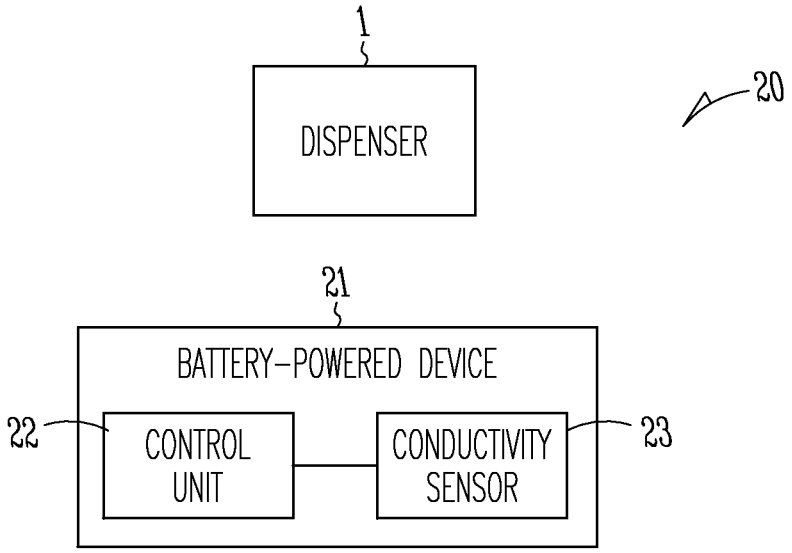
FIG. 5 is a block diagram of an embodiment of a system 20 according to one embodiment of the present subject matter to be arranged in a dishwasher.

FIG. 5 is a block diagram of an embodiment of a system 20 according to one embodiment of the present subject matter to be arranged in a dishwasher. The system 20 comprises the dispenser 1 for dispensing a detergent solution and a battery-powered device 21 for measuring the conductivity of the washing liquid.

The battery-powered device 21 comprises a control unit 22 and a conductivity sensor 23. The battery-powered device 21, the control unit 22, and the conductivity sensor 23 according to various embodiments of the present subject matter are discussed above as the "battery-powered device", "control unit", and "conductivity sensor", respectively. In one embodiment, the battery-powered device 21 is configured to operate independently of the dishwasher and to be removably retrofittable into the dishwasher, and, when the battery-powered device 21 is removably mounted in the dishwasher, the conductivity sensor 23 is configured to measure the conductivity of the washing liquid and to provide the measured conductivity value to the control unit 22, the control unit 22 is configured to process the conductivity value and to produce a signal, if the conductivity value is below a preset threshold value, in order to indicate that the dispenser 1 has to be refilled with solid detergent blocks. The signal is displayed independently of the dishwasher.

EXAMPLES

1. An exemplary system for dispensing a detergent solution from a solid detergent into a dishwasher said dishwasher comprising a washing chamber and being capable of performing cleaning cycles each including washing and rinsing periods;
   wherein the system comprises
   a dispenser for dissolving solid detergent blocks and dispensing detergent solution, wherein the dispenser is configured
   to accommodate solid detergent blocks in an amount sufficient to provide detergent solution for at least 10 cleaning cycles,
   to be removably retrofittable into the dishwasher, and,
   when removably mounted on an interior wall within the washing chamber of the dishwasher,
   to collect water or liquid sprayed within the washing chamber by a liquid inlet,
   to guide said collected water or liquid to the solid detergent blocks accommodated in the dispenser, whereby a portion of the solid detergent blocks is dissolved and a detergent solution is formed, and
   to allow continuous release of all detergent solution as it is formed;
   a battery-powered device comprising a control unit and a conductivity sensor, wherein the battery-powered device is configured to operate independently of the dishwasher and to be removably retrofittable into the dishwasher, and, when the battery-powered device is removably mounted in the dishwasher, the conductivity sensor is configured to measure the conductivity of the washing liquid and to provide the measured conductivity value to the control unit, said control unit is configured to process the conductivity value and to produce a signal, if the conductivity value is below a preset threshold value, in order to indicate that the dispenser has to be refilled with solid detergent blocks; wherein the signal is displayed independently of the dishwasher.
2. The system according to example 1, wherein the liquid inlet of the dispenser provides a clear opening space, wherein the dispenser is configured in that way that all of the collected water or liquid entering the dispenser enters the dispenser via said liquid inlet.
3. The system according to example 1 or 2, wherein the liquid inlet is designed as an exchangeable element.
4. The system according to any one of examples 1 to 3, wherein the dispenser comprises a liquid inlet, a pre-chamber, a detergent chamber and a liquid outlet in fluid communication with each other in this order, wherein the dispenser is configured to pass all of the collected water or liquid from the liquid inlet to the pre-chamber, from the pre-chamber to the detergent chamber to form the detergent solution by dissolving a portion of the solid detergent blocks, and to pass the detergent solution from the detergent chamber to the liquid outlet.
5. The system according to example 4, wherein the liquid inlet of the dispenser is arranged on a top side of the pre-chamber and is designed as an exchangeable element.
6. The system according to any one of examples 4 or 5, wherein the detergent chamber is comprising a detergent opening on the top side for introducing the solid detergent blocks and a lid, which lid when closed is sealing said opening for introducing the solid detergent blocks.
7. The system according to any one of examples 4 to 6, wherein the pre-chamber is arranged adjacent the detergent chamber and being separated from the detergent chamber by a partition wall leaving a fluid communication between the pre-chamber and the detergent chamber at the bottom.
8. The system according to any one of examples 4 to 7, wherein the detergent chamber is divided into more than one compartment by partition wall(s) leaving a fluid communication between adjacent compartments at the bottom.
9. The system according to any one of examples 4 to 8, the dispenser further comprising an additional partition wall between the liquid outlet and the adjacent detergent chamber leaving a fluid communication between the detergent chamber and the liquid outlet at the bottom, said additional partition wall acting as a vapour barrier.
10. The system according to any one of examples 1 to 9, wherein the dispenser is configured to accommodate solid detergent blocks having a total weight of 400 g to 600 g and to provide a clear opening space of the liquid inlet from 0.2 $cm^2$ to 3.0 $cm^2$.
11. The system according to any one of examples 1 to 10, wherein the dispenser comprises a mounting mechanism allowing the dispenser to be internally mounted in the dishwasher, wherein the mounting mechanism comprises a mounting plate configured to be mounted on an interior surface of the dishwasher, and the dispenser is configured to be detachably attached to the mounting plate.

12. The system according to any one of examples 1 to 11, wherein the dispenser comprises a mounting mechanism comprising a device to adjust the inclination of the dispenser when arranged within the dishwasher.

13. The system according to any one of examples 1 to 12, wherein the dispenser comprises a front wall and wherein at least the portion of the front wall covering the detergent chamber is transparent.

14. The system according to any one of examples 1 to 13 configured to represent a kit-of-parts for retrofitting a dishwasher.

15. An exemplary dispenser for dispensing a detergent solution from a solid detergent into a dishwasher, wherein the dispenser is configured
   - to accomodate solid detergent blocks in an amount sufficient to provide detergent solution for at least 10 cleaning cycles,
   - to be removably retrofittable into the dishwasher, and, when removably mounted on an interior wall within the washing chamber of the dishwasher,
   - to collect water or liquid sprayed within the washing chamber by a liquid inlet,
   - to guide said collected water or liquid to the solid detergent blocks accomodated in the dispenser, whereby a portion of the solid detergent blocks is dissolved and a detergent solution is formed, and
   - to allow continuous release of all detergent solution as it is formed.

16. The dispenser according to example 15, wherein the liquid inlet of the dispenser provides a clear opening space, wherein the dispenser is configured in that way that all of the collected water or liquid entering the dispenser enters the dispenser via said liquid inlet.

17. The dispenser according to example 15 or 16, wherein the liquid inlet is designed as an exchangeable element.

18. The dispenser according to any one of examples 15 to 17, wherein the dispenser comprises a liquid inlet, a pre-chamber, a detergent chamber and a liquid outlet in fluid communication with each other in this order, wherein the dispenser is configured to pass all of the collected water or liquid from the liquid inlet to the pre-chamber, from the pre-chamber to the detergent chamber to form the detergent solution by dissolving a portion of the solid detergent blocks, and to pass the detergent solution from the detergent chamber to the liquid outlet.

19. The dispenser according to example 18, wherein the liquid inlet of the dispenser is arranged on a top side of the pre-chamber and is designed as an exchangeable element.

20. The dispenser according to any one of examples 18 or 19, wherein the detergent chamber is further comprising a detergent opening on the top side for introducing the solid detergent blocks and a lid, which lid when closed is sealing said opening for introducing the solid detergent blocks.

21. The dispenser according to any one of examples 18 to 20, wherein the pre-chamber is arranged adjacent the detergent chamber and being separated from the detergent chamber by a partition wall leaving a fluid communication between the pre-chamber and the detergent chamber at the bottom.

22. The dispenser according to any one of examples 18 to 21, wherein the detergent chamber is divided into more than one compartment by partition wall(s) leaving a fluid communication between adjacent compartments at the bottom.

23. The dispenser according to any one of examples 18 to 22, the dispenser further comprising an additional partition wall between the liquid outlet and the adjacent detergent chamber leaving a fluid communication between the detergent chamber and the liquid outlet at the bottom, said additional partition wall acting as a vapour barrier.

24. The dispenser according to any one of examples 15 to 23, wherein the dispenser is configured to accommodate solid detergent blocks having a total weight of 400 g to 600 g and to provide a clear opening space of the liquid inlet from 0.2 $cm^2$ to 3.0 $cm^2$.

25. The dispenser according to any one of examples 15 to 24, wherein the dispenser comprises a mounting mechanism allowing the dispenser to be internally mounted in the dishwasher, wherein the mounting mechanism comprises a mounting plate configured to be mounted on an interior surface of the dishwasher, and the dispenser is configured to be detachably attached to the mounting plate.

26. The dispenser according to any one of examples 15 to 25, wherein the dispenser comprises a mounting mechanism comprising a device to adjust the inclination of the dispenser when arranged within the dishwasher.

27. The dispenser according to any one of examples 15 to 26, wherein the dispenser comprises a front wall and wherein at least the portion of the front wall covering the detergent chamber is transparent.

28. A dispenser for dispensing a detergent solution from a solid detergent into a dishwasher, said dispenser comprising a liquid inlet, a detergent chamber and a liquid outlet in fluid communication with each other in this order, wherein the dispenser is configured to pass all of the liquid collected by the dispenser from the liquid inlet to the detergent chamber to form the detergent solution by dissolving a portion of the solid detergent blocks, to pass the detergent solution from the detergent chamber to the liquid outlet, and to allow continuous release of all detergent solution as it is formed.

29. The dispenser according to example 28, wherein the liquid inlet is designed as an exchangeable element for varying a clear opening space of the liquid inlet.

30. The dispenser according to example 28 or 29, wherein the dispenser comprises an additional chamber adjacent the detergent chamber and wherein the liquid inlet of the dispenser is arranged on a top side of the dispenser providing an opening into said additional chamber.

31. The dispenser according to any one of examples 28 to 30, wherein the dispenser is configured to accommodate solid detergent blocks having a total weight of 400 g to 600 g and to provide a clear opening space of the liquid inlet from 0.2 $cm^2$ to 3.0 $cm^2$.

32. The dispenser according to any one of examples 28 to 31, wherein the detergent chamber is further comprising a detergent opening on the top side for introducing the solid detergent blocks and a lid, which lid when closed is sealing said opening for introducing the solid detergent blocks.

33. The dispenser according to any one of examples 28 to 32, wherein the detergent chamber is divided into more than one compartment by partition wall(s) leaving a fluid communication between adjacent compartments at the bottom.

34. The dispenser according to any one of examples 28 to 33, the dispenser further comprising an additional partition wall between the liquid outlet and the adjacent detergent chamber leaving a fluid communication between the detergent chamber and the liquid outlet at the bottom, said additional partition wall acting as a vapour barrier.

35. The dispenser according to any one of examples 28 to 34, wherein the dispenser comprises a mounting mechanism allowing the dispenser to be internally mounted in the dishwasher, wherein the mounting mechanism comprises a mounting plate configured to be mounted on an interior surface of the dishwasher, and the dispenser is configured to be detachably attached to the mounting plate.

36. The dispenser according to any one of examples 28 to 35, wherein the dispenser comprises a mounting mechanism comprising a device to adjust the inclination of the dispenser when arranged within the dishwasher.

37. The dispenser according to any one of examples 28 to 36, wherein the dispenser comprises a front wall and wherein at least the portion of the front wall covering the detergent chamber is transparent.

38. The dispenser according to any one of examples 28 to 37, the dispenser is configured to accommodate solid detergent blocks in an amount sufficient to provide detergent solution for at least 10 cleaning cycles, to be removably retrofittable into the dishwasher, and, when removably mounted on an interior wall within the washing chamber of the dishwasher, to collect water or liquid sprayed within the washing chamber by a liquid inlet, to guide said collected water or liquid to the solid detergent blocks accommodated in the dispenser, whereby a portion of the solid detergent blocks is dissolved and a detergent solution is formed, and to allow continuous release of all detergent solution as it is formed.

39. An exemplary set comprising a dispenser for dispensing a detergent solution from a solid detergent into a dishwasher, said dispenser comprising a liquid inlet, a detergent chamber and a liquid outlet, wherein the dispenser is configured to pass all of the liquid collected by the dispenser from the liquid inlet to the detergent chamber to form the detergent solution by dissolving a portion of the solid detergent blocks, to allow continuous release of the detergent via the liquid outlet, wherein the liquid inlet is designed as an exchangeable element; and a first exchangeable element intended to be mounted to the dispenser to form the liquid inlet, said first exchangeable element providing a specific clear opening space.

40. The set according to example 39, comprising one or more further exchangeable element(s) intended to be mounted to the dispenser to form the liquid inlet, said one or more further exchangeable element(s) each providing a specific clear opening space different from that of the first exchangeable element and different from each other.

41. The set according to example 39 or 40, wherein the dispenser is configured to accommodate solid detergent blocks having a total weight of 400 g to 600 g and is configured to be varied with respect to the clear opening space of the liquid inlet from 0.2 $cm^2$ to 3.0 $cm^2$ by exchanging an exchangeable element by another.

42. The set according to any one of examples 39 to 41, wherein the dispenser comprises an additional chamber adjacent the detergent chamber and wherein the liquid inlet of the dispenser is arranged on a top side of the dispenser providing an opening into said additional chamber.

43. The set according to any one of examples 39 to 42, wherein the detergent chamber is further comprising a detergent opening on the top side for introducing the solid detergent blocks and a lid, which lid when closed is sealing said opening for introducing the solid detergent blocks.

44. The set according to any one of examples 39 to 43, wherein the detergent chamber is divided into more than one compartment by partition wall(s) leaving a fluid communication between adjacent compartments at the bottom.

45. The set according to any one of examples 39 to 44, the dispenser further comprising an additional partition wall between the liquid outlet and the adjacent detergent chamber leaving a fluid communication between the detergent chamber and the liquid outlet at the bottom, said additional partition wall acting as a vapour barrier.

46. The set according to any one of examples 39 to 45, wherein the dispenser comprises a mounting mechanism allowing the dispenser to be internally mounted in the dishwasher, wherein the mounting mechanism comprises a mounting plate configured to be mounted on an interior surface of the dishwasher, and the dispenser is configured to be detachably attached to the mounting plate.

47. The set according to any one of examples 39 to 46, wherein the dispenser comprises a mounting mechanism comprising a device to adjust the inclination of the dispenser when arranged within the dishwasher.

48. The set according to any one of examples 39 to 47, wherein the dispenser comprises a front wall and wherein at least the portion of the front wall covering the detergent chamber is transparent.

49. An exemplary method for dispensing a detergent solution from a dispenser in a dishwasher capable of performing cleaning cycles each including washing and rinsing periods, the method comprising:

i. placing one or more solid detergent blocks each comprising a washing agent and a rinsing agent in a detergent chamber of the dispenser in an amount sufficient to provide detergent solution for at least 10 cleaning cycles;

ii. collecting a portion of water or liquid sprayed within the dishwasher during the washing and rinsing periods and using the collected water to form a detergent solution in the detergent chamber of the dispenser by dissolving a portion of the solid detergent;

iii. continuously releasing all of the detergent solution from the dispenser as it is formed;

iv. measuring the conductivity of the washing liquid by a conductivity sensor of a battery-powered device arranged within the dishwasher, v. providing the measured conductivity value to a control unit of the battery-powered device for processing, vi. producing a signal by the control unit, if the conductivity value is below a preset threshold value, in order to indicate that the dispenser has to be refilled with solid detergent blocks, and displaying the signal independently of the dishwasher.

50. The method according to example 49, comprising before steps i. to vi. the following steps a. to c. in any order:
   a. selecting and installing a specific clear opening space of a liquid inlet of the dispenser;
   b. removably retrofitting a dispenser in the dishwasher; and
   c. removably retrofitting a battery-powered device comprising a control unit and a conductivity sensor in the dishwasher.

51. The method according to example 49 or 50, wherein the signal is displayed by the battery-powered device, preferably in the form of a light signal.

52. The method according to example 49 or 50, wherein the signal is send by the battery-powered device to an external device located outside of the dishwasher by wireless communication, for displaying by the external device.

53. The method according to any one of examples 49 to 52, wherein the liquid inlet is designed as an exchangeable element and wherein the method further comprises a step of altering the specific clear opening space of said liquid inlet by exchanging the exchangeable element by another exchangeable element having a different specific clear opening space.

54. Use of the system according to any one of examples 1 to 14 for removably retrofitting and/or operating a dishwasher with said system.

55. Use of the dispenser according to any one of examples 15 to 38 or the set according to any one of examples 39 to 48 for removably retrofitting and/or operating a dishwasher with said dispenser.

56. Dishwasher comprising the system according to any one of examples 1 to 14 or the dispenser according to any one of examples 15 to 38 or the set according to any one of examples 39 to 48, or wherein the dishwasher is configured to carry out the method according to any one of examples 49 to 53.

LIST OF REFERENCE NUMBERS

1 dispenser
2 liquid inlet
3 pre-chamber/additional chamber
4 detergent chamber
5 liquid outlet
6 partition walls
7 additional partition wall (vapour barrier)
8 lid
9 detergent opening
10 side wall (comprising liquid outlet 5)

This application is intended to cover adaptations or variations of the present subject matter. It is to be understood that the above description is intended to be illustrative, and not restrictive. The scope of the present invention should be determined with reference to the appended claims, along with the full scope of legal equivalents to which such claims are entitled.

What is claimed is:

1. A system for dispensing a detergent solution from a solid detergent into a dishwasher, the dishwasher including a washing chamber and being capable of performing cleaning cycles each including washing and rinsing periods, the system comprising:

a dispenser for dissolving solid detergent blocks and dispensing detergent solution, the dispenser configured to:
   accommodate solid detergent blocks in an amount sufficient to provide detergent solution for at least 10 cleaning cycles;
   be removably retrofittable into the dishwasher by being mounted on an interior wall within the washing chamber of the dishwasher;
   collect water or liquid sprayed within the washing chamber;
   guide the collected water or liquid to the solid detergent blocks accommodated in the dispenser, whereby a portion of the solid detergent blocks is dissolved and a detergent solution is formed; and
   allow continuous release of all detergent solution as it is formed; and a battery-powered device configured to operate independently of the dishwasher and to be removably retrofittable into the dishwasher, the battery-powered device including a control unit and a conductivity sensor, the conductivity sensor configured to measure the conductivity of the washing liquid and to provide the measured conductivity value to the control unit when the battery-powered device is removably mounted in the dishwasher, the control unit configured to process the conductivity value and to produce a signal to be displayed independently of the dishwasher to indicate that the dispenser is to be refilled with solid detergent blocks if the conductivity value is below a preset threshold value.

2. The system of claim 1, wherein the dispenser comprises a liquid inlet configured to collect the water or liquid sprayed within the washing chamber, and the dispenser is configured in a way that all of the collected water or liquid entering the dispenser enters the dispenser via the liquid inlet.

3. The system of claim 2, wherein the liquid inlet comprises an exchangeable element.

4. The system of claim 3, wherein the exchangeable element is configured to be mounted to the dispenser to form the liquid inlet, the exchangeable element configured to provide a specific clear opening space.

5. The system of claim 4, further comprising one or more further exchangeable elements each configured to be mounted to the dispenser to form the liquid inlet, the one or more further exchangeable elements each providing a specific clear opening space different from that of the first exchangeable element and different from each other.

6. The system of claim 1, wherein the dispenser comprises a liquid inlet, a pre-chamber, a detergent chamber and a liquid outlet in fluid communication with each other in this order, wherein the dispenser is configured to pass all of the collected water or liquid from the liquid inlet to the pre-chamber, from the pre-chamber to the detergent chamber to form the detergent solution by dissolving a portion of the solid detergent blocks, and to pass the detergent solution from the detergent chamber to the liquid outlet.

7. The system of claim 6, wherein the liquid inlet of the dispenser is arranged on a top side of the pre-chamber and comprises an exchangeable element.

8. The system of claim 7, wherein the detergent chamber comprises a detergent opening on the top side for introducing the solid detergent blocks and a lid, which lid when closed is sealing the opening for introducing the solid detergent blocks.

9. The system of claim 8, wherein the pre-chamber is arranged adjacent the detergent chamber and being separated from the detergent chamber by a partition wall leaving a fluid communication between the pre-chamber and the detergent chamber at the bottom.

10. The system of claim 9, wherein the detergent chamber is divided into more than one compartment by partition wall(s) leaving a fluid communication between adjacent compartments at the bottom.

11. The system of claim 10, wherein the dispenser further comprises an additional partition wall between the liquid outlet and the adjacent detergent chamber leaving a fluid communication between the detergent chamber and the liquid outlet at the bottom, the additional partition wall acting as a vapour barrier.

12. The system of claim 1, wherein the dispenser is configured to accommodate solid detergent blocks having a total weight of 400 g to 600 g and to provide a clear opening space of the liquid inlet from 0.2 $cm^2$ to 3.0 $cm^2$.

13. The system of claim 1, wherein the dispenser comprises a mounting mechanism allowing the dispenser to be internally mounted in the dishwasher, wherein the mounting mechanism comprises a mounting plate configured to be mounted on an interior surface of the dishwasher, and the dispenser is configured to be detachably attached to the mounting plate.

14. The system of claim 13, wherein the mounting mechanism comprises a device to adjust the inclination of the dispenser when arranged within the dishwasher.

15. The system of claim 1, wherein the dispenser comprises a front wall and wherein at least the portion of the front wall covering the detergent chamber is transparent.

16. A method for dispensing a detergent solution from a dispenser in a dishwasher capable of performing cleaning cycles each including washing and rinsing periods, the method comprising:

placing one or more solid detergent blocks each including a washing agent and a rinsing agent in a detergent chamber of the dispenser in an amount sufficient to provide detergent solution for at least 10 cleaning cycles;

collecting a portion of water or liquid sprayed within the dishwasher during the washing and rinsing periods and using the collected water to form a detergent solution in the detergent chamber of the dispenser by dissolving a portion of the solid detergent;

continuously releasing all of the detergent solution from the dispenser as it is formed;

measuring the conductivity of the washing liquid by a conductivity sensor of a battery-powered device arranged within the dishwasher;

providing the measured conductivity value to a control unit of the battery-powered device for processing; and producing a signal by the control unit, if the conductivity value is below a preset threshold value, in order to indicate that the dispenser has to be refilled with solid detergent blocks, and displaying the signal independently of the dishwasher.

17. The method of claim 16, further comprising:

selecting and installing a specific clear opening space of a liquid inlet of the dispenser;

removably retrofitting the dispenser in the dishwasher; and removably retrofitting the battery-powered device in the dishwasher.

18. The method of claim 17, wherein displaying the signal comprises displaying a light signal by the battery-powered device.

19. The method of claim 17, wherein displaying the signal comprises:

sending the signal from the battery-powered device to an external device located outside of the dishwasher by wireless communication; and displaying the signal by the external device.

20. The method of claim 17, further comprising:

configuring the liquid inlet as an exchangeable element; and altering the specific clear opening space of the liquid inlet by exchanging the exchangeable element by another exchangeable element having a different specific clear opening space.

* * * * *